US009375101B2

(12) United States Patent
Elliott et al.

(10) Patent No.: US 9,375,101 B2
(45) Date of Patent: Jun. 28, 2016

(54) CONVERTIBLE TRADESHOW TRAVEL CASE AND METHOD

(71) Applicants: Jared L. Elliott, Prior Lake, MN (US); Nathan D. Wenninger, Prior Lake, MN (US)

(72) Inventors: Jared L. Elliott, Prior Lake, MN (US); Nathan D. Wenninger, Prior Lake, MN (US)

(73) Assignee: Source Products L.L.C., Prior Lake, MN (US)

( * ) Notice: Subject to any disclaimer, the term of this patent is extended or adjusted under 35 U.S.C. 154(b) by 35 days.

(21) Appl. No.: 14/484,237

(22) Filed: Sep. 11, 2014

(65) Prior Publication Data

US 2015/0150388 A1 Jun. 4, 2015

Related U.S. Application Data

(60) Provisional application No. 61/911,442, filed on Dec. 3, 2013.

(51) Int. Cl.

| | |
|---|---|
| ***A47B 43/00*** | (2006.01) |
| ***A47F 3/00*** | (2006.01) |
| ***A47F 5/10*** | (2006.01) |
| ***A47F 9/00*** | (2006.01) |
| ***E04H 1/12*** | (2006.01) |

(52) U.S. Cl.

CPC ..... *A47F 3/004* (2013.01); *A47F 5/108* (2013.01); *A47F 9/00* (2013.01); *E04H 1/1272* (2013.01); *E04H 2001/1283* (2013.01); *Y10T 29/49893* (2015.01)

(58) Field of Classification Search

CPC ..... A47B 43/00; A47B 87/00; A47B 87/002; A47B 87/005; A47B 87/0204; A47B 87/0292; A47F 3/00; A47F 3/004; B65D 19/06; B65D 88/02; B65D 88/022; B65D 88/12; B65D 90/00; B65D 90/0033

USPC ..... 206/386, 577, 600; 211/2, 189–206; 312/107, 108, 111, 114, 117–123

See application file for complete search history.

(56) References Cited

U.S. PATENT DOCUMENTS

| | | | | |
|---|---|---|---|---|
| 2,791,323 | A * | 5/1957 | Schreckengost | B41F 13/0024 206/386 |
| 3,226,172 | A * | 12/1965 | Bateman | A47F 3/00 211/2 |
| 4,673,092 | A | 6/1987 | Lamson et al. | |
| 5,718,494 | A | 2/1998 | Luddemann | |
| 6,027,188 | A | 2/2000 | Nickens | |
| 6,951,283 | B2 | 10/2005 | Savoie | |
| 7,841,676 | B2 * | 11/2010 | Hawkins | A47B 45/00 312/107 |
| 7,948,447 | B2 | 5/2011 | Weis et al. | |
| 7,988,244 | B2 | 8/2011 | Haws, Jr. | |

* cited by examiner

*Primary Examiner* — Bryon Gehman

(74) *Attorney, Agent, or Firm* — Charles A. Lemaire; Jonathan M. Rixen; Lemaire Patent Law Firm, P.L.L.C.

(57) ABSTRACT

A travel case that converts from a palletable shipping container into one or more display cabinet(s) and/or table(s). In some embodiments, the container includes first and second dual-box units each having two open-faced boxes connected to one another along an edge of each by a first hinge. One box of each unit includes a bottom pallet portion to allow the apparatus to be lifted and carried by a forklift. In some embodiments, the first unit unfolds from a stacked configuration where its first box is stacked upon its second box to a dual-table configuration where the first box is side-by-side the second box, and wherein the height of the second box including the bottom pallet portion is substantially equal to the height of the first box. In some embodiments, a second unit connects to the first unit to enclose the inner volumes of the first and second box.

20 Claims, 15 Drawing Sheets

120
112
113
122
143
132
145
142
145
133

101
110
154
111
155
120
112
122
145
132
142
145
143
154
143
141
121
131

CONVERTIBLE TRADESHOW TRAVEL CASE AND METHOD

CROSS-REFERENCE TO RELATED APPLICATION

This application claims priority benefit, under 35 U.S.C. §119(e), of U.S. Provisional Patent Application No. 61/911,442 filed Dec. 3, 2013 by Jared L. Elliott,et al., titled "Convertible travel case and method," which is incorporated herein by reference in its entirety.

FIELD OF THE INVENTION

This invention relates to travel cases and shipping containers and more specifically to a method and tradeshow display apparatus that converts from a palletable shipping container into display cabinet(s) and/or table(s), for example, useful for demonstrating and/or displaying goods at a trade show.

BACKGROUND OF THE INVENTION

Numerous conventional display-demonstration systems have been attempted, but all leave much to be desired.

U.S. Pat. No. 6,951,283 to Savoie issued Oct. 4, 2005 with the title "Storage and transport system for collapsible tradeshow displays" and is incorporated herein by reference. Savoie describes a storage and transport system for collapsible tradeshow displays preferably comprises a crate and framework in combination with components of a collapsible display system. By providing a crate and framework for more vertical storing and accessing the components and for organizing the components as they are placed in the crate, users may more efficiently set up and tear down the display system where there is limited floor space. The crate is durable and the framework securely holds components in place for safe and secure transportation.

U.S. Pat. No. 5,718,494 to Luddemann issued Feb. 17, 1998 with the title "Convertible storage system" and is incorporated herein by reference. Luddemann describes a convertible system which is changeable from a portable storage mode to a display mode is formed by a first container, a second container and conversion material. The second container and the conversion material are held within the first container when the system is in the storage mode and the conversion material is removable from the first container and used to convert the system from the storage mode to the display mode.

U.S. Pat. No. 6,027,188 to Nickens issued Feb. 22, 2000 with the title "Case-to-counter conversion kit" and is incorporated herein by reference. Nickens describes a case-to-counter conversion kit that includes two case bodies that are positioned to form a storage space between them. Two shelves are attached between the case bodies to provide storage surfaces and to lock the bodies together, thereby forming a stable base for a counter. The shelves include tongues along opposite edges of the shelves. The tongues slide into tracks or moldings attached in channels which are located on opposing faces of the case bodies, thereby locking the shelves and bodies together. A multi-section counter top is attached to the tops of the case bodies and locked in place by pins located in channels on the tops of the case bodies which engage slots in mating faces of the counter top sections. A roll-up counter top cover fits into a recess in the top of the counter assembly. A flexible panel is wrapped around the case bodies and secured in place with hook and loop fasteners. A hinged door is attached to the flexible panel and provides access to the storage space between the case bodies. The shelves, counter top sections, and counter top cover are designed to fit in the case bodies when not in use.

U.S. Pat. No. 7,988,244 to Haws, Jr. issued Aug. 2, 2011 with the title "Modular merchandise pod" and is incorporated herein by reference. Haws, Jr. describes a modular merchandise pod that includes a generally elongated merchandise pod base having first and second ends, a rack assembly carried by the merchandise pod base and disposed generally midway between the first and second ends and a rack assembly top panel carried by the rack assembly.

U.S. Pat. No. 7,948,447 to Weis et al. issued May 24, 2011 with the title "Mobile display" and is incorporated herein by reference. Weis et al. describe a mobile, multi-room display environment that is "cratable" or "palletizeable." The display environment has a first room, the first room having a first set of sensory cues, and a second room, the second room having a second set of sensory cues substantially different from the first set of sensory cues. The first and second rooms are designed for temporary use and can be easily disassembled for transport from one location to another in a separate crate or on a pallet. By "cratable" it is meant that the mobile display is designed to be disassembled and the component parts placed into a crate or crates for storage or transport for re-assembly at a different time or location. By "palletizeable" it is meant that the modular components of the mobile display are designed to be secured to a pallet for storage and transport for re-assembly at some other time or location.

U.S. Pat. No. 4,673,092 to Lamson et al. issued Jun. 16, 1987 with the title "Multi-level rack assembly" and is incorporated herein by reference. Lamson et al. describe a multi-level rack assembly comprising a plurality of base members each including a generally rectangular platform portion and an upstanding tubular portion at each corner of the platform portion having a plug dividing the interior thereof into upper and lower tubular volumes; a plurality of side support members each including a pair of spaced upstanding tubular portions and truss means interconnecting the tubular portions; and a plurality of core rod means sized to fit slidably within the tubular portions of the base members and of the side support members. In one embodiment, the core rods are elongated and unitary and have a length somewhat greater than the length of the side support member tubular portions so that the core rods may extend vertically within the side support member tubular portions and seat at their lower ends in the upper tubular volumes of the tubular portions of a lower base member and seat at their upper ends in the lower tubular volumes of the tubular portions of an upper base member. In another embodiment, each of the core rod means comprises a pair of core rod members each including an upper portion sized to fit slidably within the lower end of the tubular portion of an associated side support member or the lower tubular volume of a tubular portion of an upper base member; a lower rod portion sized to fit slidably within the upper end of the tubular portion of the associated side support member or the upper tubular volume of a tubular portion of a lower base member; and a collar portion intermediate the upper and lower rod portions to define the respective seated positions of the upper and lower rod portions.

What is needed is a shipping container having an enclosed volume for shipping and security of its contents, wherein the container readily converts into display cabinet(s) and/or table (s) and/or shelving unit(s), and then reconverts back into a secured enclosure for overnight storage and/or back into a shipping container.

SUMMARY OF THE INVENTION

In some embodiments, the present invention provides a method and apparatus for making travel cases and shipping containers that convert into furniture, as well as a resulting method and apparatus that converts from a palletted shipping container (a shipping container having a built-in pallet base suitable for use with a forklift) into display cabinet(s) and/or table(s) that are useful, for example, for demonstrating and/or displaying goods at a trade show.

In some embodiments, the present invention provides a method for making a convertible travel case that converts from a palletable enclosed shipping container into one or more display cabinets and/or tables. This method includes forming a first unit of the container that includes a plurality of open-faced boxes including a first open-faced box having a height and an inner volume and a second open-faced box having a height and an inner volume, including forming the second open-faced box on a bottom pallet portion having at least one forklift-accessible opening configured to allow the convertible travel case to be lifted and carried by a forklift, wherein the height of the second open-faced box including the bottom pallet portion is substantially equal to the height of the first open-faced box; forming a second unit of the container; connecting the first open-faced box and the second open-faced box of the first unit to one another along an edge of each; unfolding the first dual-box unit along an axis of the connected edges of the first open-faced box and the second open-faced box of the first unit from a first enclosed shipping configuration in which the first open-faced box is folded against the second open-faced box, to a second display configuration in which the first open-faced box is on a floor next to the second open-faced box; and removably connecting a second unit to the first unit to selectively enclose the inner volume of the first open-faced box and the inner volume of the second open-faced box when in the first enclosed shipping configuration.

In some embodiments, the present invention provides a convertible travel case apparatus that converts from a palletable enclosed shipping container into one or more display cabinets and/or tables. The convertible travel case apparatus includes a first unit that includes a plurality of open-faced boxes including: a first open-faced box having a height and an inner volume and a second open-faced box having a height and an inner volume, wherein the first open-faced box and the second open-faced box of the first unit are connected to one another along an edge of each by a first edge-connector system, wherein the second open-faced box includes a bottom pallet portion having at least one forklift-accessible opening configured to allow the apparatus to be lifted and carried by a forklift, wherein the first dual-box unit is configured to be unfolded along an axis of the first edge-connector system from a first enclosed shipping configuration in which the first open-faced box is folded against the second open-faced box, to a second display configuration in which the first open-faced box is on a floor next to the second open-faced box, and wherein the height of the second open-faced box including the bottom pallet portion is substantially equal to the height of the first open-faced box; and a second unit that connects to the first unit to selectively enclose the inner volume of the first open-faced box and the inner volume of the second open-faced box when in the first enclosed shipping configuration.

DESCRIPTION OF PREFERRED EMBODIMENTS

Although the following detailed description contains many specifics for the purpose of illustration, a person of ordinary skill in the art will appreciate that many variations and alterations to the following details are within the scope of the invention. Specific examples are used to illustrate particular embodiments; however, the invention described in the claims is not intended to be limited to only these examples, but rather includes the full scope of the attached claims. Accordingly, the following preferred embodiments of the invention are set forth without any loss of generality to, and without imposing limitations upon the claimed invention. Further, in the following detailed description of the preferred embodiments, reference is made to the accompanying drawings that form a part hereof, and in which are shown by way of illustration specific embodiments in which the invention may be practiced. It is understood that other embodiments may be utilized and structural changes may be made without departing from the scope of the present invention. The embodiments shown in the Figures and described here may include features that are not included in all specific embodiments. A particular embodiment may include only a subset of all of the features described, or a particular embodiment may include all of the features described.

The leading digit(s) of reference numbers appearing in the Figures generally corresponds to the Figure number in which that component is first introduced, such that the same reference number is used throughout to refer to an identical component which appears in multiple Figures. Signals and connections may be referred to by the same reference number or label, and the actual meaning will be clear from its use in the context of the description.

Figures 1A, 1B:
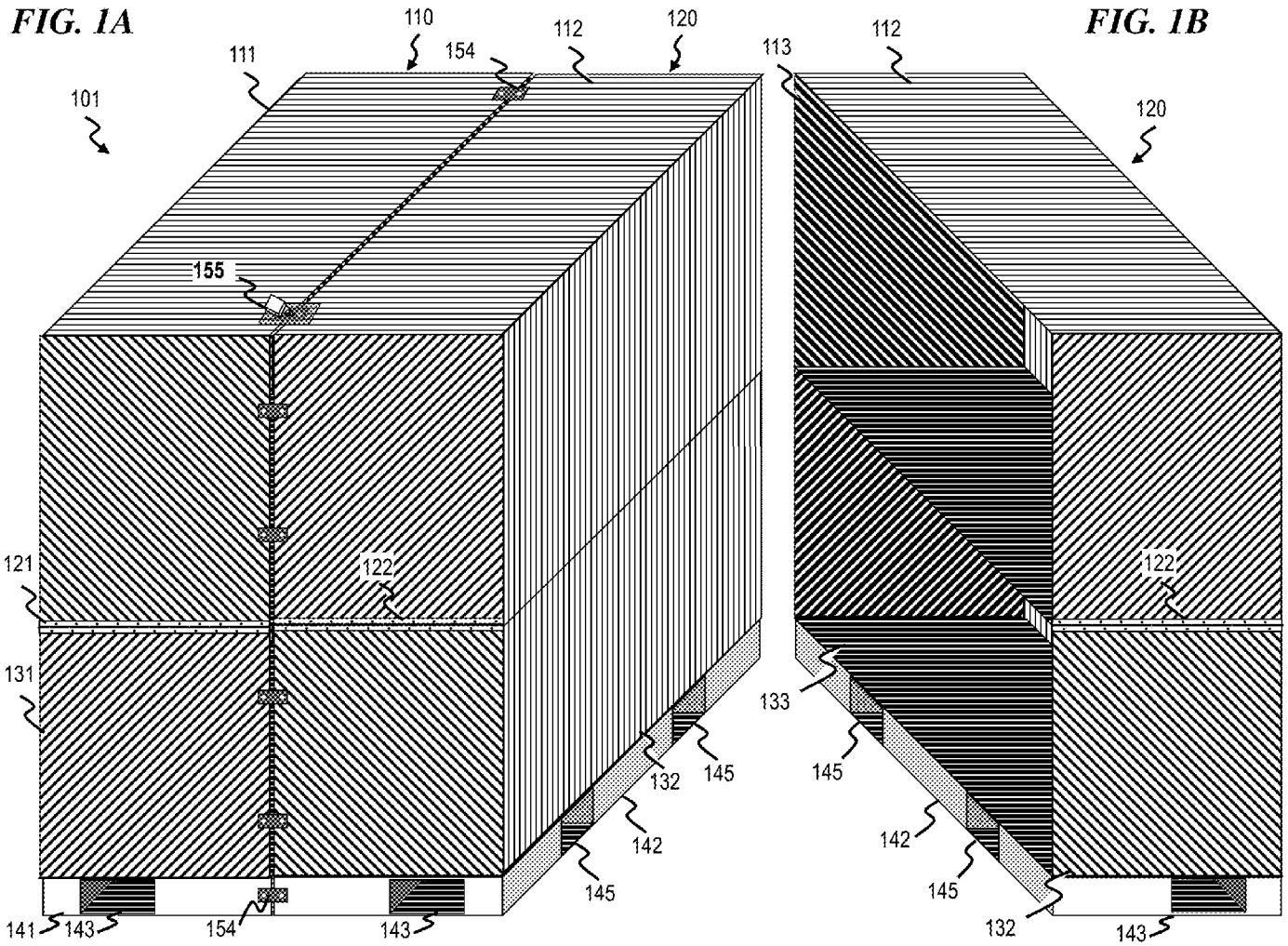
FIG. 1A is a cabinet-projection view of a symmetric convertible shipping container 101 in the shipping-container assembled configuration, according to one embodiment of the present invention.
FIG. 1B is a cabinet-projection view of one-half 120 of convertible shipping container 101 in the partially disassembled configuration, according to one embodiment of the present invention.

FIG. 1A is a cabinet-projection view of a symmetric convertible shipping container 101 in the shipping-container assembled configuration, according to one embodiment of the present invention. When in the shipping-container configuration, the plurality of modular parts of convertible shipping container 101 form an enclosed "clamshell" type of container that has an enclosed volume having a pallet-type base 141-142 that makes container 101 moveable by standard or conventional forklift or pallet-jack equipment.

In some embodiments, one part of the clamshell includes a first pair of polyhedrons (e.g., in some embodiments, five-walled rectangular units, each unit having a top wall, a bottom wall, and three side walls attached at right angles to the top wall, the bottom wall and to their adjacent wall(s); in other embodiments, other polyhedrons shapes may be used). The first pair of five-walled rectangular units are stacked one on top of the other for shipping, the upper unit being hinged (or otherwise connected, at least for shipment) to the lower unit, the upper unit, without a pallet base, having substantially or exactly the same vertical dimension and horizontal dimensions as the lower unit with its pallet base, such that when unfolded, the pair of units stand side-by-side to form a desk-like piece of furniture for a tradeshow display. The bottom wall of the top unit and the top wall of the lower unit form the top exterior surface of the "desk."

In some embodiments, another part of the clamshell includes a second pair of polyhedrons (e.g., in some embodiments, again these are also five-walled rectangular units stacked one on top of the other, the upper unit being hinged (or otherwise connected, at least for shipment) to the lower unit, the upper unit (without a pallet base) having substantially or exactly the same vertical dimension and horizontal dimensions as the lower unit with its pallet base, such that when unfolded, the pair of units site side-by-side to form a desk-like piece of furniture for a tradeshow display, wherein the top surfaces of the unfolded units being co-planar. The top surfaces of the desk-like piece of furniture formed by the first pair of units are facing one another when stacked or folded and assembled into their shipping configuration, thus protecting these surfaces from the scuffs that typically result from standard shipping and moving activities.

When assembled into their shipping configuration, the first pair of stacked five-walled rectangular units and the second pair of stacked five-walled rectangular units are assembled to each other with their respective open sides facing each other so that no sides remain open, in order to form an enclosure that can be used to store and safeguard other tradeshow paraphernalia, handouts, samples, literature and the like. In some embodiments, the first pair of stacked five-walled rectangular units each has substantially the same depth as the second pair of stacked five-walled rectangular units, while in other embodiments, they have different depths. In some embodiments, the second pair of stacked units is replaced by a third modular component formed by a single five-walled rectangular unit (or a flat panel having no partially enclosed volume) having the same height and width as the overall height and width of the first pair of stacked five-walled rectangular units. In some embodiments, the second pair of stacked units is replaced by a fourth modular component formed by a pair of side-by-side five-walled rectangular units having the same height and overall width as the overall height and width of the first pair of stacked five-walled rectangular units. In some embodiments, the enclosed shipping container includes the third modular component formed by the single five-walled rectangular unit with its open face facing and attached to the fourth modular unit formed by the pair of side-by-side five-walled rectangular units having the same height and overall width as the overall height and width of the third modular component.

Thus, in some embodiments, the convertible shipping container devices of the present invention can be formed by any two-unit combination of the first (two stacked open-faced boxes of a first depth), second (two stacked open-faced boxes of a second depth different from the first depth), third (a single open-faced box) and fourth (a pair of side-by-side open-faced boxes) modular units.

In some embodiments, the devices of the present invention are sized for convenient loading or unloading by forklift or pallet jack. In some embodiments, devices of the present invention are less than three cubic meters in volume, and weigh less than 450 kg (about 1000 pounds) when loaded. In some embodiments, devices of the present invention are less than five cubic meters in volume, and weigh less than 2250 kg (about 5000 pounds) when loaded. In some embodiments, devices of the present invention are less than ten cubic meters in volume, and weigh less than 4,500 kg (about 10,000 pounds) when loaded.

In embodiments having a "built-in" pallet base, "built-in" is meant to indicate that the pallet base is a permanent part of at least some portions of the modular device, such that those portions are used in the tradeshow display without removing their pallet base. In some embodiments, some portions of the device not having a pallet base are attached (such as by a hinge) or attachable (such as by a separable attachment feature) to the portions having a pallet base.

Because the modular transportable convertible tradeshow display and shipping enclosure is portable and transportable, it can be reused at many locations and for many purposes. The enclosure can be closed to substantially its shipping configuration and locked in order to secure valuable samples overnight at a tradeshow, and easily and quickly opened to tradeshow configuration the next morning, wherein the external container again becomes furniture of a sales booth. Similarly, at the end of a tradeshow, the enclosure can be closed to its shipping configuration and locked in order to secure valuable samples for shipment to its next location.

Referring again to FIG. 1A, in some embodiments, a first stacked dual-box unit 110 of the clamshell includes a first pair of polyhedrons 111 and 131 (e.g., in some embodiments, five-walled rectangular units, each unit having a top wall, a bottom wall, and three side walls attached at right angles to the top wall, the bottom wall and to their adjacent wall(s); in other embodiments, other polyhedrons shapes may be used). The first stacked dual-box unit 110 of five-walled rectangular units are stacked one on top of the other for shipping, the upper unit 111 being hinged by hinge 121 (or otherwise connected, at least for shipment) to the lower unit 131. The upper unit 111 (which, in some embodiments, does not have a pallet base), has substantially or exactly the same vertical dimension and horizontal dimensions as the lower unit 131 with its pallet base 142, such that when unfolded, the pair of units 111 and 131 stand side-by-side (see FIG. 1E) to form a desk-like piece of furniture 103 for a tradeshow display. The bottom wall 115 of the top unit 111 and the top wall 135 of the lower unit 131 form the top exterior surface of the "desk" 103. In some embodiments, a plurality of connectors 154 (such as steel straps or bars held with bolts to threaded holes in units 111-112, 131-132, and pallet-type bases 141-142. In some embodiments, one or more of the plurality of connectors 154 includes a locking-coverplate-and-lock 155 that prevents removing the connectors 154 without opening the locking cover first. The second pair 120 of five-walled rectangular units are stacked one on top of the other for shipping, the upper unit 112 being hinged by hinge 122 (or otherwise connected, at least for shipment) to the lower unit 132. In some embodiments, the pallet-type bases 141-142 include a plurality of forklift receptacles 145 along the long faces of pallet-type bases 141 and 142, and/or forklift receptacles 143 along the short faces of pallet-type bases 141 and 142. In some embodiments, pallet-type bases 141 and 142 are constructed of welded steel square tubing or other suitable materials (such as a molded polymer composite).

Note that the cross-hatch shading of all the Figures does not represent a cross-section of a metal unit, but rather is intended to indicate the different outer faces of the various exterior (and interior) walls of the convertible shipping container 101.

FIG. 1B is a cabinet-projection view of one-half 120 of convertible shipping container 101 in the partially disassembled configuration, according to one embodiment of the present invention. FIG. 1B shows the open inside volume 113 of top unit 112, and the open inside volume 133 of bottom unit 132.

Figures 1C, 1D, 1E:
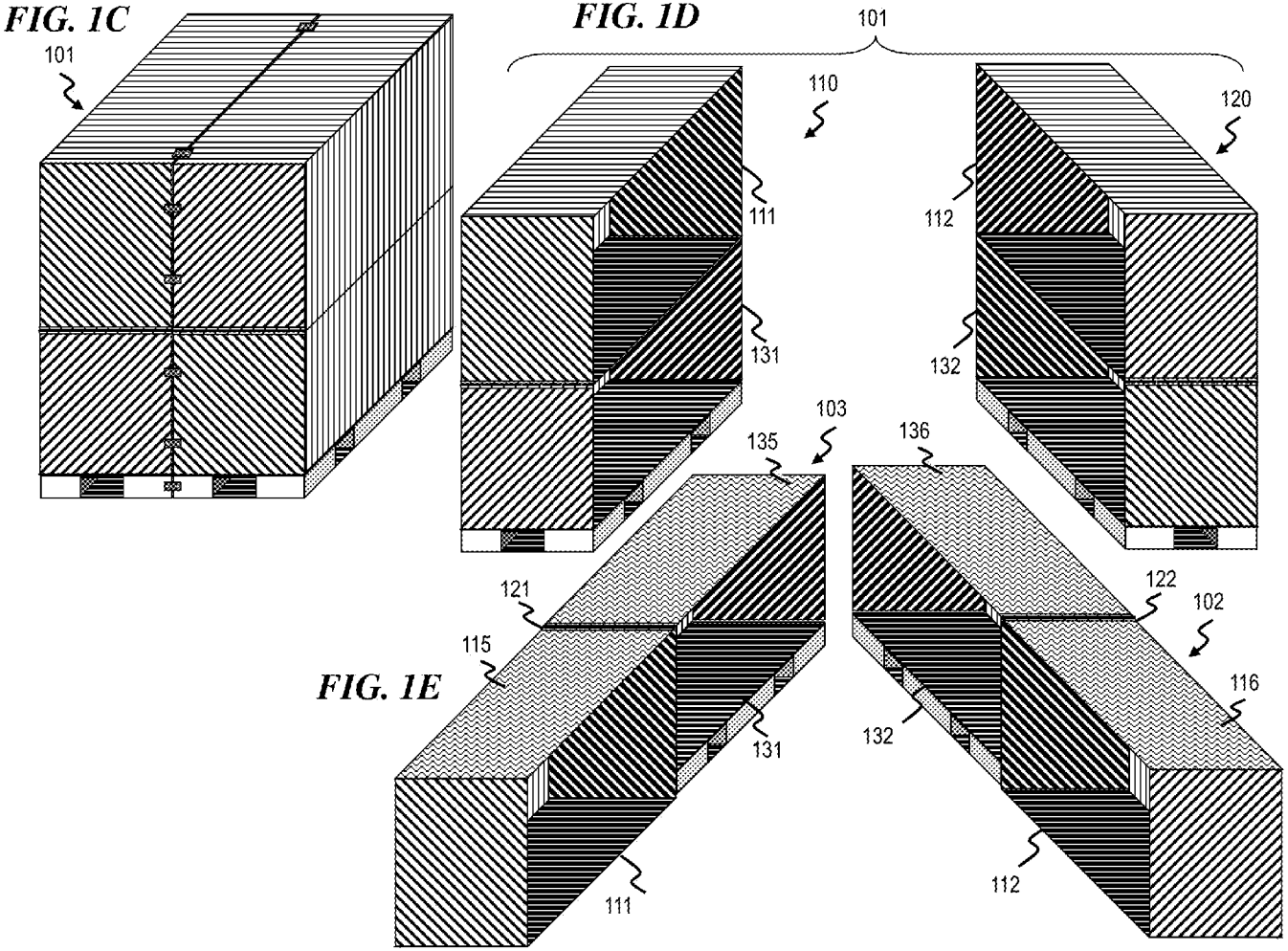
FIG. 1C is another (reduced-size) cabinet-projection view of symmetric convertible shipping container 101 in the shipping-container assembled configuration.
FIG. 1D is a cabinet-projection view of convertible shipping symmetric container 101 in a partially disassembled and separated configuration.
FIG. 1E is a cabinet-projection view of convertible shipping symmetric container 101 in an assembled tradeshow-furniture configuration of two double-wide table-like display units.

FIG. 1C is another (reduced-size) cabinet-projection view of convertible shipping container 101 in the shipping-container assembled configuration that is shown in FIG. 1A. In a method used in some embodiments of the invention, FIG. 1C represents a first operation (or step) result of moving the convertible shipping container 101 to a tradeshow floor. The connectors 154 (See FIG. 1A) are then removed, and the two halves 110 and 120 of the clamshell enclosure 101 are separated from one another, resulting in a configuration such as shown in FIG. 1D.

FIG. 1D is a cabinet-projection view of convertible shipping symmetric container 101 in a partially disassembled and separated configuration. In the method used in some embodiments of the invention, FIG. 1D represents a second operation result of disconnecting the two halves 110 and 120 after moving the convertible shipping container 101 to the tradeshow floor. In some embodiments, the two halves 110 and 120 of the clamshell enclosure would typically be full of various samples, prototypes and/or items for sale.

FIG. 1E is a cabinet-projection view of convertible shipping symmetric container 101 in an assembled tradeshow-furniture configuration of two double-wide table-like display units. In the method used in some embodiments of the invention, FIG. 1E represents a third operation result of deploying the two halves 110 and 120 (e.g., in some embodiments, by rotating the top units 111 and 112 around the rotational axes of their respective hinges 121 and 122), after moving the convertible shipping container 101 to the tradeshow floor and separating the two halves 110 and 120 in their respective table-like configurations 103 and 102. In some embodiments, the hinges 121 and 122 keep the units 111 and 112 (formerly the top units) attached to the bottom units 131 and 132. In other embodiments, separable hinges or other attachment means are used to hold the top units 111 and 112 to the bottom units 131 and 132 during shipping, and these detachable connections allow the top units 111 and 112 to be separated from the bottom units 131 and 132 (thus forming up to four (or more)) separable table-like pieces of furniture during the tradeshow deployment. In some embodiments, the two units 102 and 103 can be moved together with their open faces adjacent and then locked to one another (e.g., using conventional hasps and locks, not shown) for overnight security of the contents held in the interior volumes. In other embodiments, the device is reassembled to the shipping-container configuration for overnight locking of contents.

In the method used in some embodiments of the invention, FIG. 1D then represents a fourth operation result of readying the two halves 110 and 120 for shipment after the tradeshow is over (e.g., in some embodiments, by rotating the top units 111 and 112 around the rotational axes of their respective hinges 121 and 122), and them moving the two halves 110 and 120 together and then FIG. 1C then represents a fifth operation result of locking the two halves 110 and 120 to one another for shipment. This method, in some embodiments, allows the sales people to secure and lock the container after the tradeshow concludes, and then leave the premises without waiting, such that the forklift operator can later move the secured and locked container 101 to a truck for the return trip.

Figure 1F:
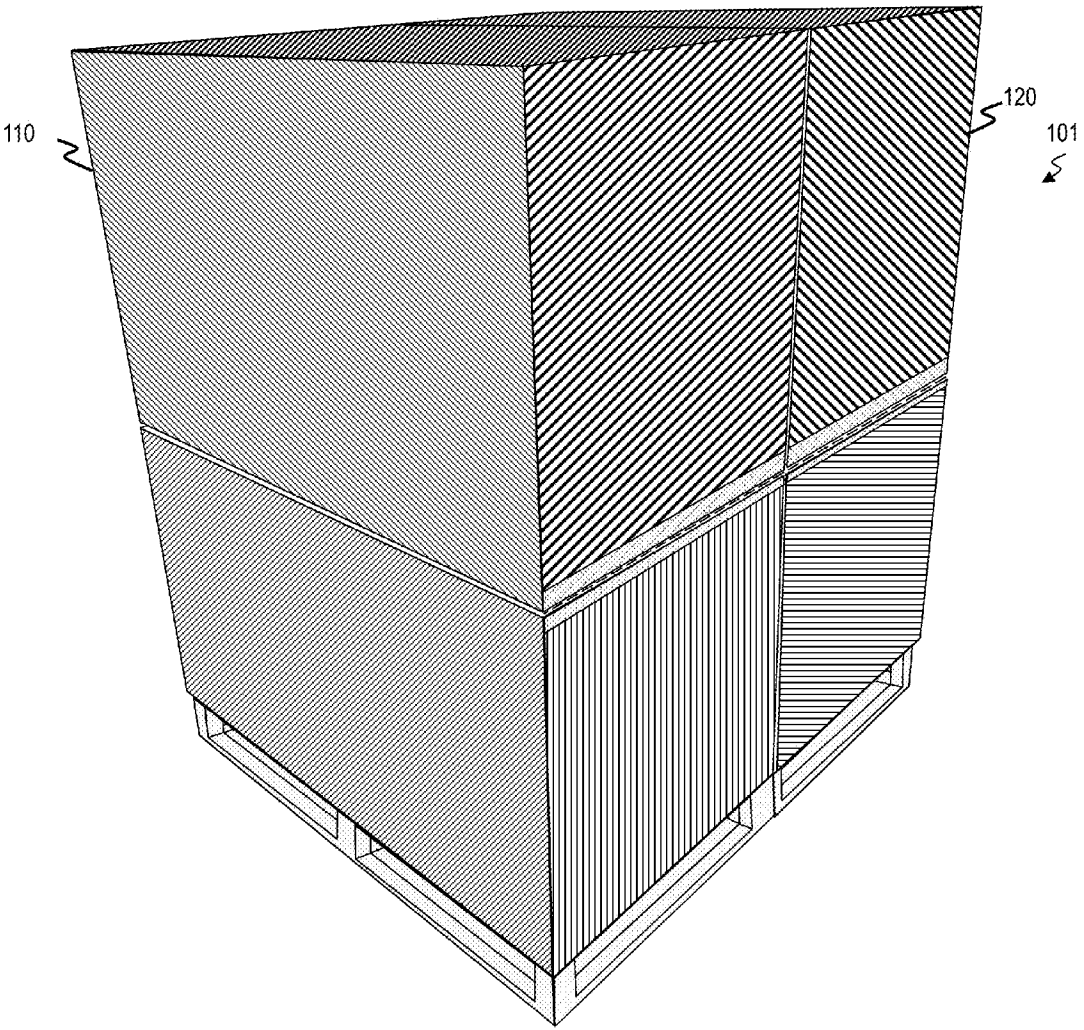
FIG. 1F is a perspective view showing convertible shipping container 101 with its two halves (these halves are also called stacked dual-box units) 110 and 120 in the closed shipping-container configuration, according to one embodiment of the present invention.

FIG. 1F is a perspective view showing convertible shipping container 101 with its two halves 110 and 120 in the closed shipping-container configuration, according to one embodiment of the present invention. This is another view of convertible shipping container 101 of FIGS. 1A-1E.

Figure 1G:
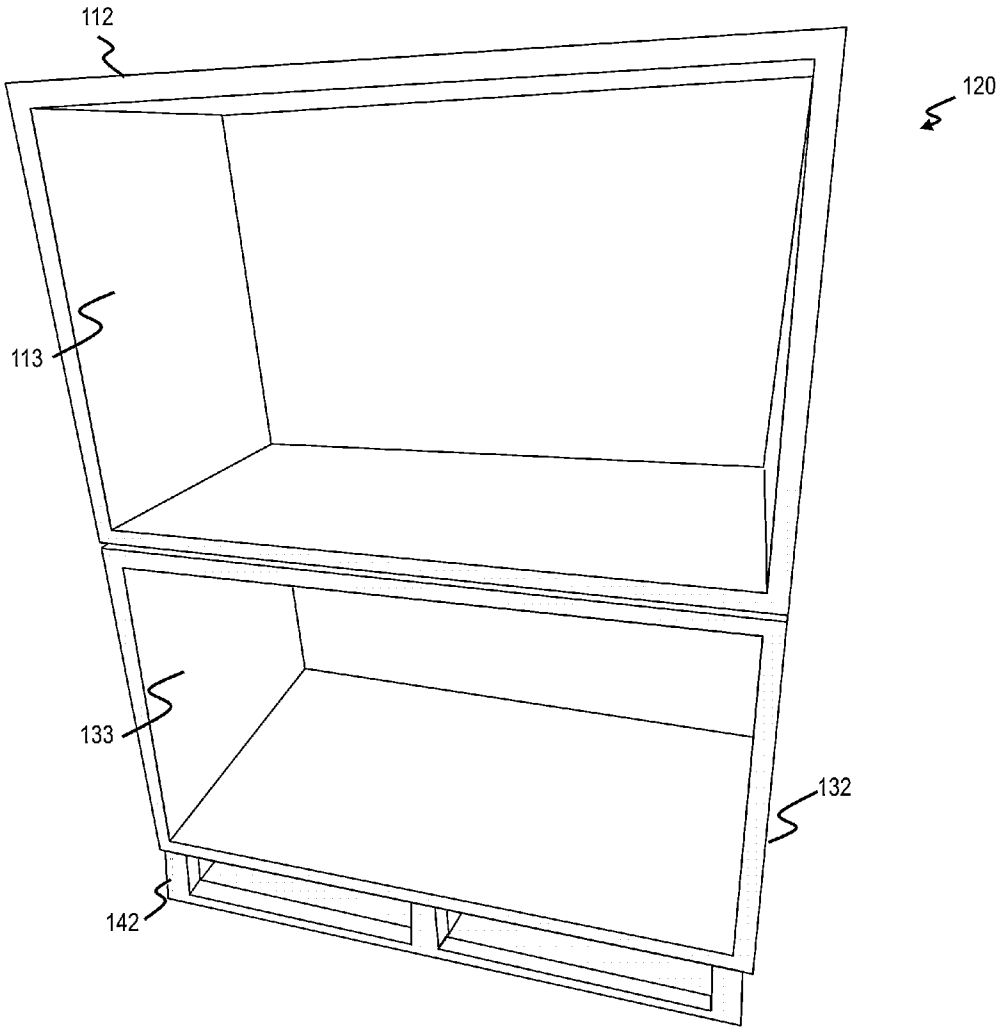
FIG. 1G is a perspective view showing the inside of one half 120 of convertible shipping container 101 in the partially opened configuration, according to one embodiment of the present invention.

FIG. 1G is a perspective view showing the inside of one half 120 of convertible shipping container 101 in the partially opened configuration, according to one embodiment of the present invention. In some embodiments, two units (here, a top unit 112 having an interior volume 113 and a bottom unit 132 having an interior volume 133) are stacked atop one another. In other embodiments (not shown), a single, full-height unit is used instead. In still other embodiments (not shown), three or more, partial-height units are used instead (e.g., top unit 112 can be replaced by two half-wide side-by-side units, which are attached to one another and stacked on and attached to the bottom unit 132 (which includes a pallet-like base 142) for shipment (e.g., by two hinges, one at each end of bottom unit 132)).

Figure 1H:
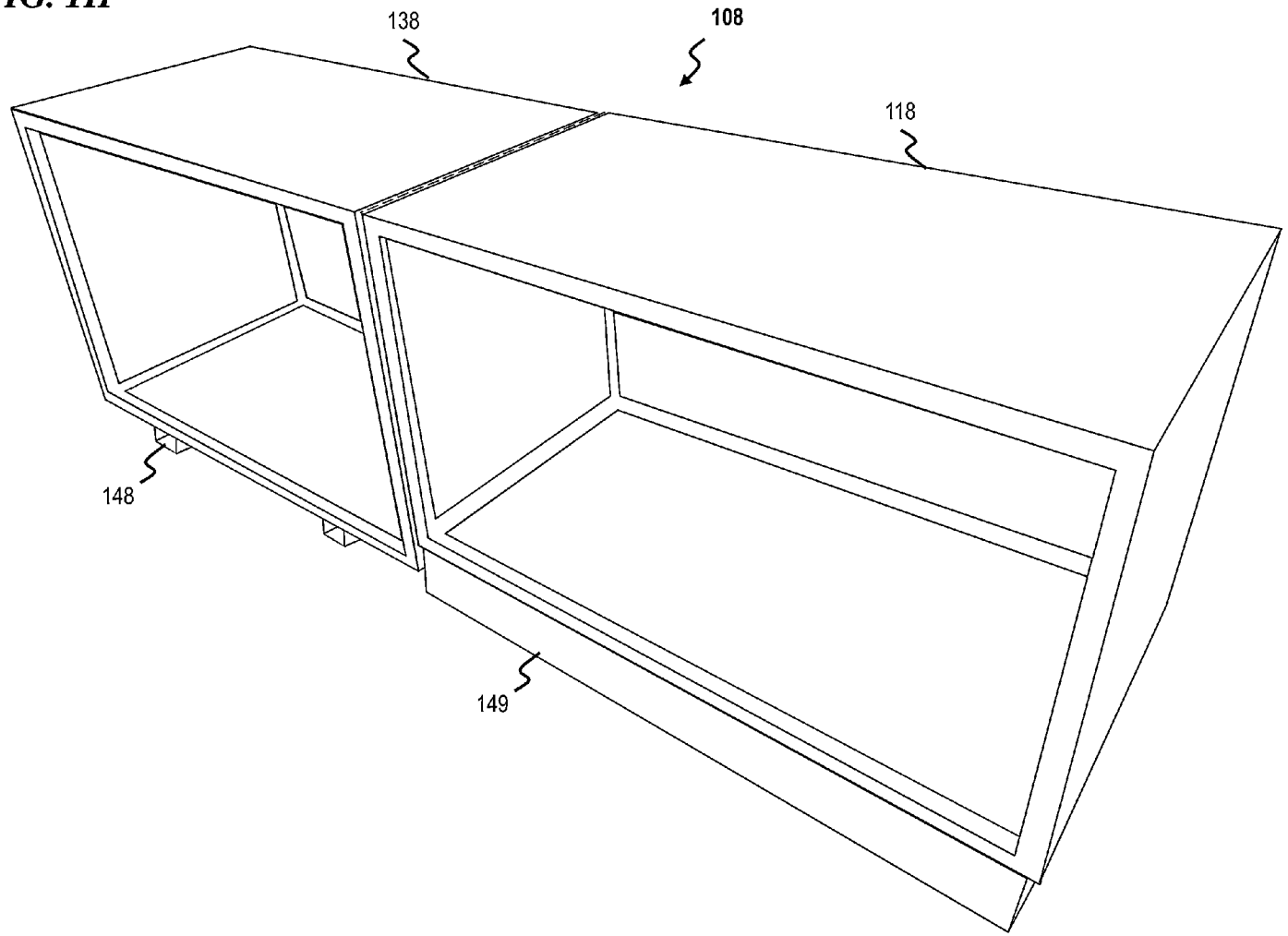
FIG. 1H is a perspective view of one half 108 of a different version of convertible shipping symmetric container 108 in an assembled-deployed tradeshow-furniture configuration of one double-wide table-like display unit.

FIG. 1H is a perspective view of one half 108 of a different version of convertible shipping symmetric container 108 in an assembled-deployed tradeshow-furniture configuration of one double-wide table-like display unit. In such embodiments, other arrangements of pallet-base units 148 are used and/or one or more floor-stand spacers 149 (which can be shipped inside the top unit 118 or bottom unit 138) are used in order that bottom unit 138 can have a different height than top unit 118, wherein spacer(s) 149 are sized to compensate for the height differences between units 118 and 138. In this embodiment, top unit 118 is quite a bit shorter, so spacer 149 is taller than pallet base 148 in order to have the top surfaces co-planar. In other embodiments, the top surfaces need not be coplanar, and the top surface of unit 118 can be higher or lower than the top surface of unit 138.

Figure 1I:
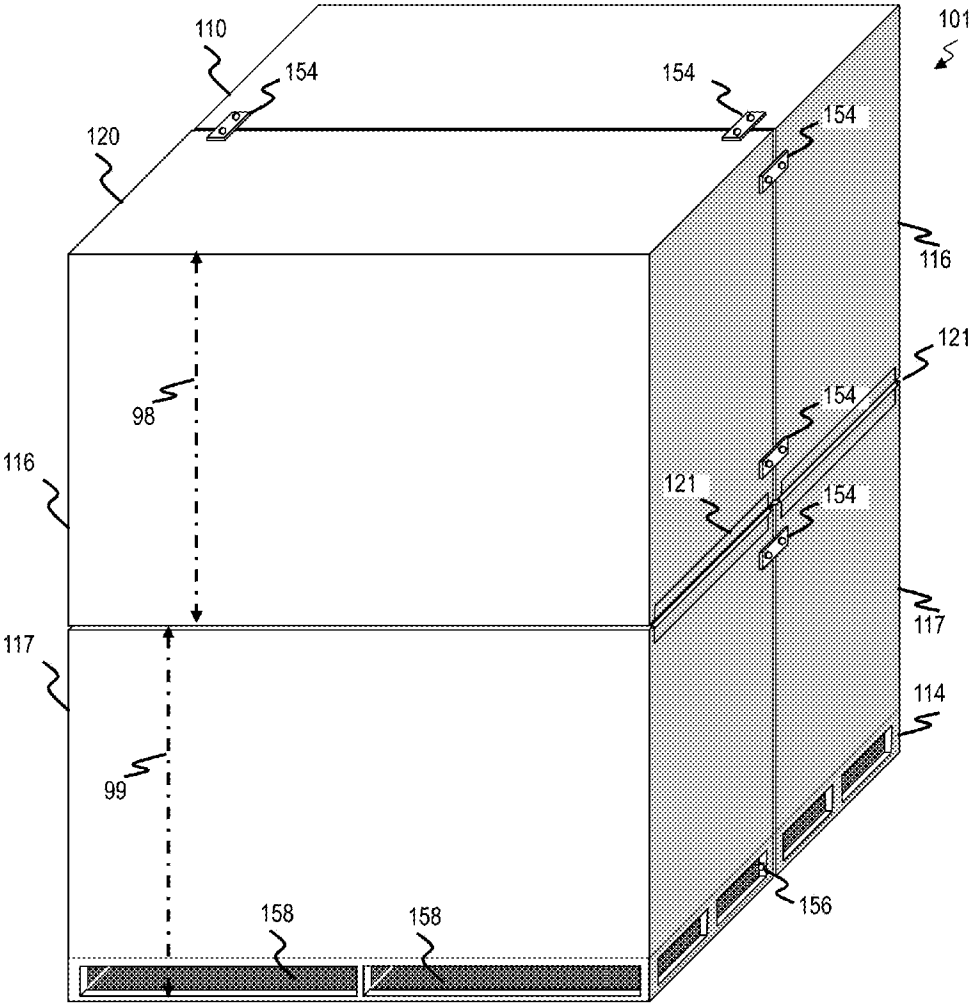
FIG. 1*i* is an isometric drawing of a convertible shipping container 101 in the shipping configuration, according to one embodiment of the present invention.
Figure 1J:
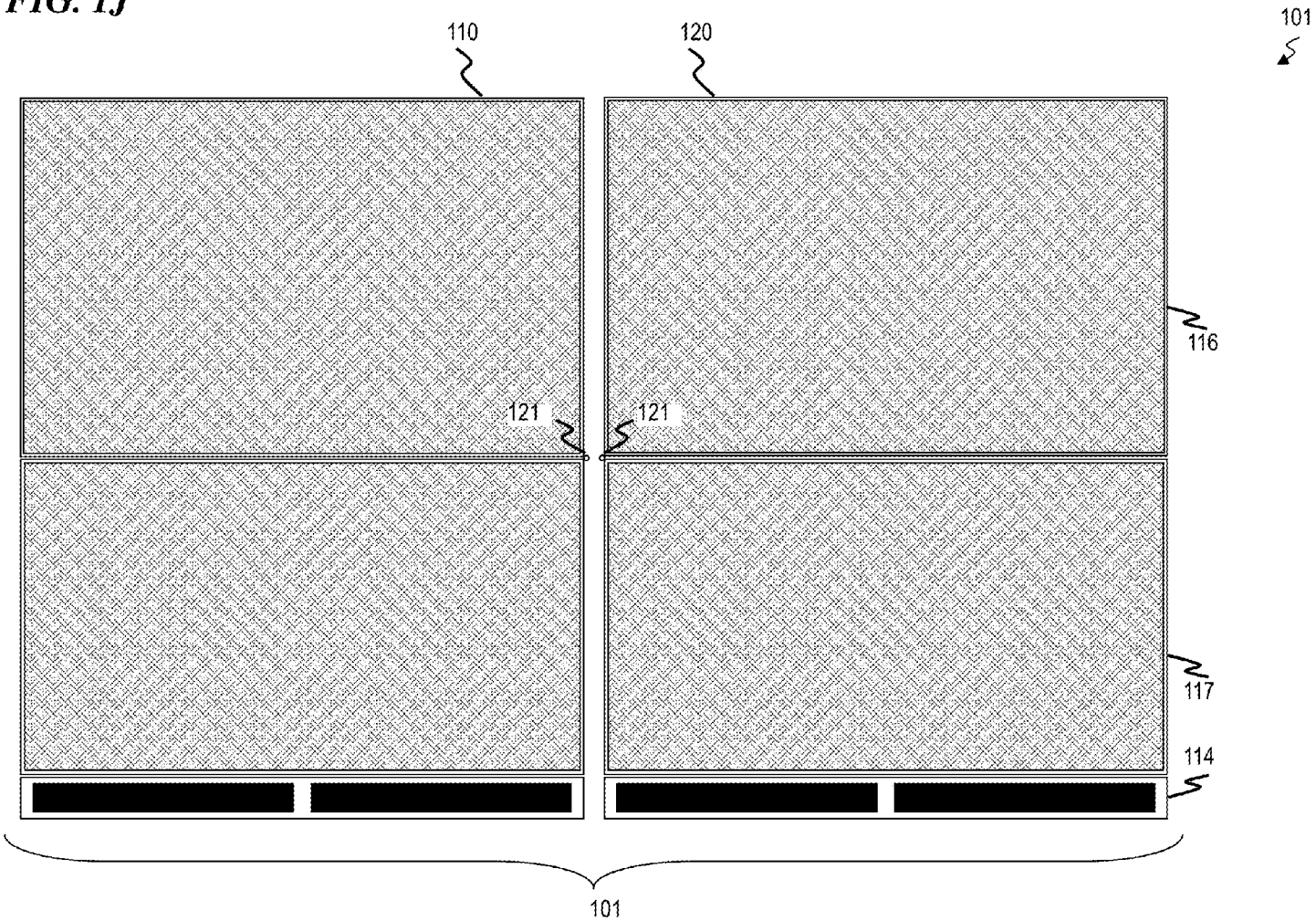
FIG. 1J is an inside-elevation-view drawing of the insides of the two halves of convertible shipping container 101 in the unpacking configuration, according to one embodiment of the present invention.
Figure 1L:
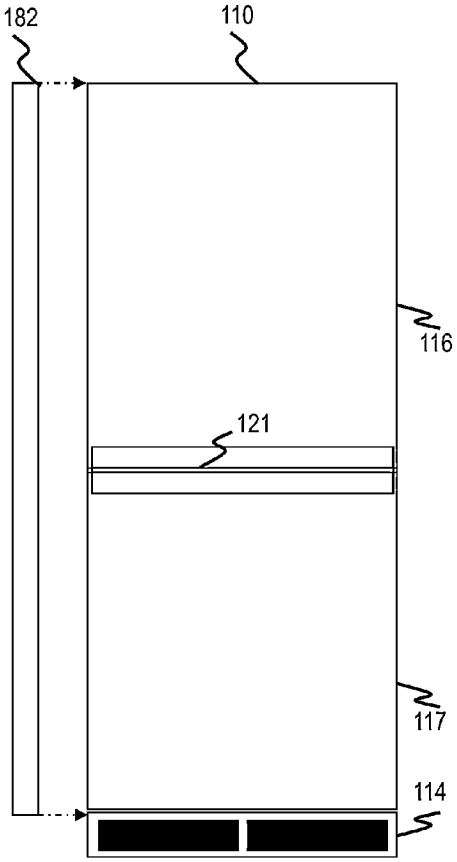
FIG. 1L is a side-elevation-view drawing of the side of one half of convertible shipping container 101 in the display-shelf configuration, according to one embodiment of the present invention.

FIG. 1*i* is an isometric drawing of a convertible shipping container 101 in the shipping configuration, according to one embodiment of the present invention. In some embodiments, convertible shipping container 101 includes a first stacked dual-box unit 110, and optionally also a second stacked dual-box unit 120 that is identical to or substantially a mirror-image of box 110. Each stacked dual-box unit (110 and 120) includes a first (upper) open-faced box 116 (serving as boxes 111 or 112 in FIG. 1A) having a height 98 and an inner volume 96 (see FIG. 1M) and a second (lower) open-faced box 117 (which includes pallet portion 114; together serving as boxes 131 or 132 in FIG. 1A) having a height 99 and an inner volume 97 (see FIG. 1M), wherein the first open-faced box 116 and the second open-faced box 117 are connected to one another along an edge of each by a first hinge 121, wherein the second open-faced box 117 includes a bottom pallet portion 114 having at least one forklift-accessible opening 158 configured to allow the apparatus 101 to be lifted and carried by a forklift or wheeled pallet jack, wherein the first dual-box unit 110 is configured to be unfolded along an axis of the first hinge 121 from a stacked configuration (as shown in FIG. 1D and FIG. 1J) in which the first open-faced box 116 is stacked upon the second open-faced box 117, to a dual-table configuration (as shown in FIG. 1E and FIG. 1M) in which the first open-faced box 116 is side-by-side next to the second open-faced box 117, and wherein the height 99 of the second open-faced box 117 including the bottom pallet portion 114 is substantially equal to the height 98 of the first open-faced box 116; and a second stacked dual-box unit (which is unit 120 in some embodiments; but in other embodiments, is simply a flat cover (such as cover 182 of FIG. 1L) or a shallower shelf unit (as depicted in FIG. 2A-2F, or the like)) that connects to the first unit to enclose the inner volume of the first open-faced box 116 and the inner volume of the second open-faced box 117. In some embodiments, each pallet base 114 is constructed of square-pipe tubing (e.g., in some embodiments, steel or aluminum or other suitable metal or polymer), and uses bolts 156 to secure the two pallet bases 114 to one another for shipment. In some embodiments, each pallet base 114 includes a padlock receptacle (such as hardened steel bar loops) that is used to receive a padlock for securing the convertible shipping container 101 against pilferage.

FIG. 1J is an inside-elevation-view drawing of the insides of the two halves 110 and 120 of convertible shipping container 101 in the process-of-unpacking configuration, according to one embodiment of the present invention. In some embodiments, the two halves 110 and 120 are left in this stacked display-shelf configuration for tradeshow booths and demonstrations that find this advantageous. The various features are described above with reference to FIG. 1*i*.

Figure 1K:
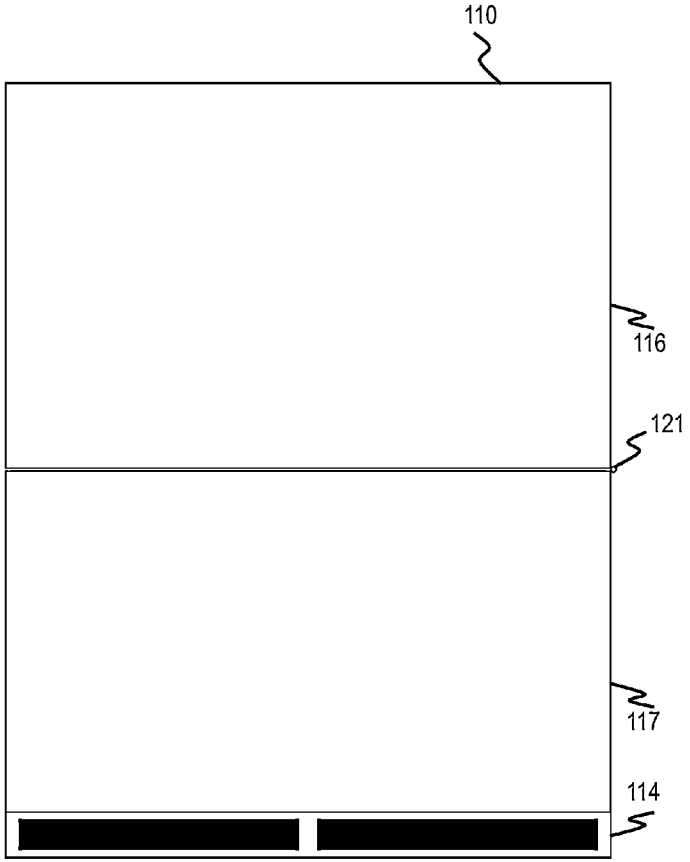
FIG. 1K is an outside-elevation-view drawing of the back/outside of one half of convertible shipping container 101 in the display-shelf configuration, according to one embodiment of the present invention.
Figure 1M:
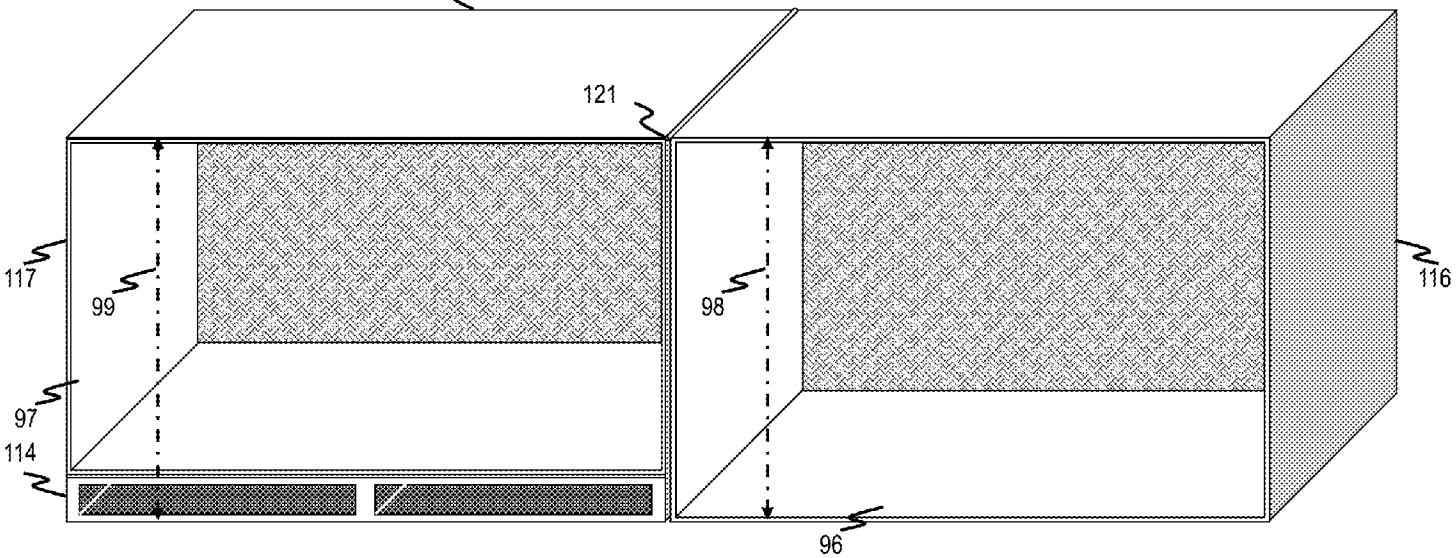
FIG. 1M is an isometric drawing of one half of convertible shipping container 100 in unfolded table configuration, according to one embodiment of the present invention.

FIG. 1K is an outside-elevation-view drawing of the back/outside of one half 110 of convertible shipping container 101 in the stacked display-shelf configuration, according to one embodiment of the present invention. The various features are described above with reference to FIG. 1*i*.

Figure 2B:
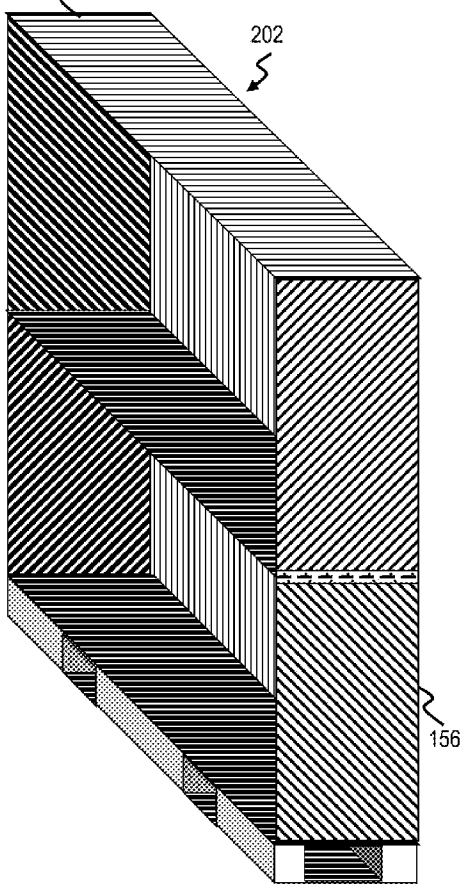
FIG. 2B is a cabinet-projection view of one part 202 of asymmetric convertible shipping container 201 in the partially disassembled configuration, according to one embodiment of the present invention.

FIG. 1L is a side-elevation-view drawing of the side of one half of convertible shipping container 101 in the stacked display-shelf configuration, according to one embodiment of the present invention. In some embodiments, a flat coverplate 182 can be affixed and/or locked to the open faces of the stacked boxes to secure their contents. In some embodiments, cover 182 affixes to the open face of unit 110 in place of unit 120, in order to make a smaller travel case (in some embodiments, unit 120 is omitted or not used, and cover 182 encloses unit 110 for shipping). In some embodiments, cover 182 is made slightly deeper (left-to-right in FIG. 1L) in order to make a closet-like structure with a larger vertical inner volume (such as shown and described below for FIGS. 2C-2F). In some embodiments, a shallower unit 204 is provided (as shown in FIG. 2C rather than unit 120 that is shown in FIG. 1*i*), optionally including additional inner shelving. In some embodiments, one of the units (e.g., unit 120) is made as a single unit without a hinge, in order to serve as a deep-shelving unit. The various features are described above with reference to FIG. 1*i*.

FIG. 1M is a cabinet-projection drawing of one half 110 of convertible shipping container 101 in unfolded table configuration, according to one embodiment of the present invention. The various features are described above with reference to FIG. 1*i*.

Figure 1N:
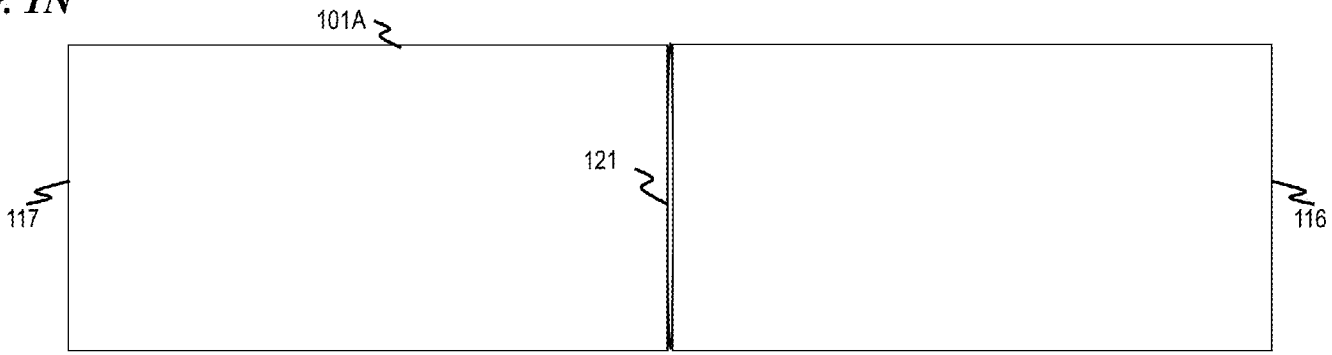
FIG. 1N is a top-view drawing of one half of convertible shipping container 100 in unfolded table configuration, according to one embodiment of the present invention.

FIG. 1N is a top-view drawing of one half of convertible shipping container 100 in unfolded table configuration, according to one embodiment of the present invention. The various features are described above with reference to FIG. 1*i*.

Figure 2A:
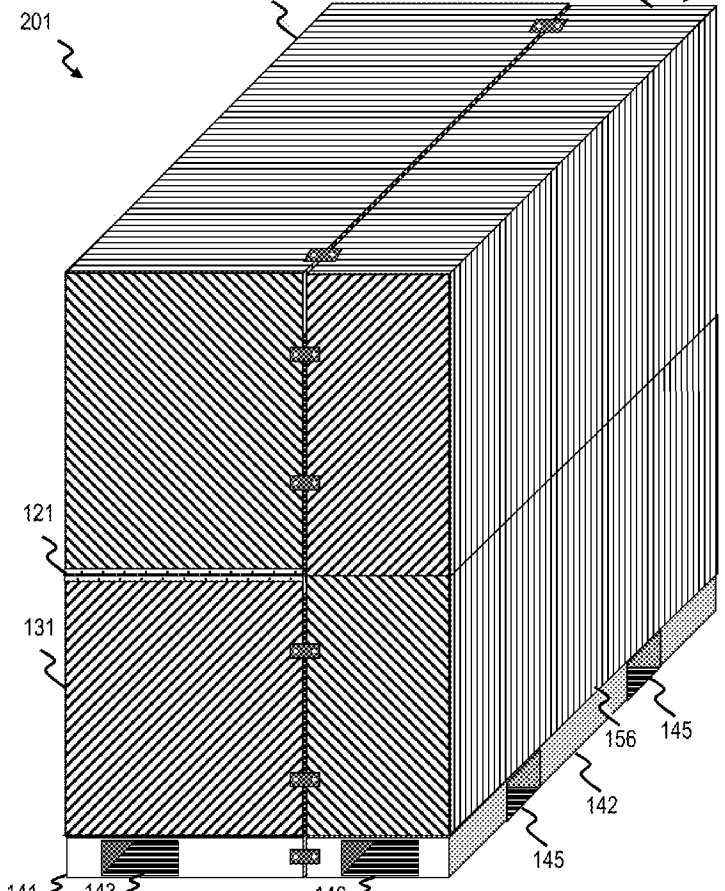
FIG. 2A is a cabinet-projection view of an asymmetric convertible shipping container 201 in the shipping-container assembled configuration, according to one embodiment of the present invention.

FIG. 2A is a cabinet-projection view of an asymmetric convertible shipping container 201 in the shipping-container assembled configuration, according to one embodiment of the present invention. In this embodiment, the right-hand part 202 is not as deep as the left-hand portion 110 (which is substantially the same as unit 110 of FIG. 1A and FIG. 1D). The pallet receptacles 145 of the narrower portion 202 line up with the receptacles 145 of the deeper portion 110. In some embodiments, the cross-wise receptacle 146 of unit 202 and receptacle 143 of unit 110 and the spaced equally from the back walls of their respective units for better balance on a forklift vehicle or pallet jack.

FIG. 2B is a cabinet-projection view of one part 202 of asymmetric convertible shipping container 201 in the partially disassembled configuration, according to one embodiment of the present invention. In some embodiments, the narrow upper portion 116 is hinged to the narrow lower portion 156, and these two stacked units can be deployed as side-by-side table by rotating the upper unit 116 around the hinge axis, in a manner described above for shipping container 101.

In any of the hinged configurations shown and described herein, a non-hinged connector system may be substituted for the hinge to obtain a similar embodiment of the present invention.

FIG. 2C is a cabinet-projection view of an asymmetric convertible shipping container 203 in the shipping-container assembled configuration, according to one embodiment of the present invention. In some embodiments, the right-hand portion 204 is a single-piece enclosure suitable for taller and/or wider contents than might fit in container 101 of FIGS. 1A-1E. In other embodiments, a plurality of shelves or other contents-organizing features are provided in the interior of right-hand portion 204.

Figure 2D:
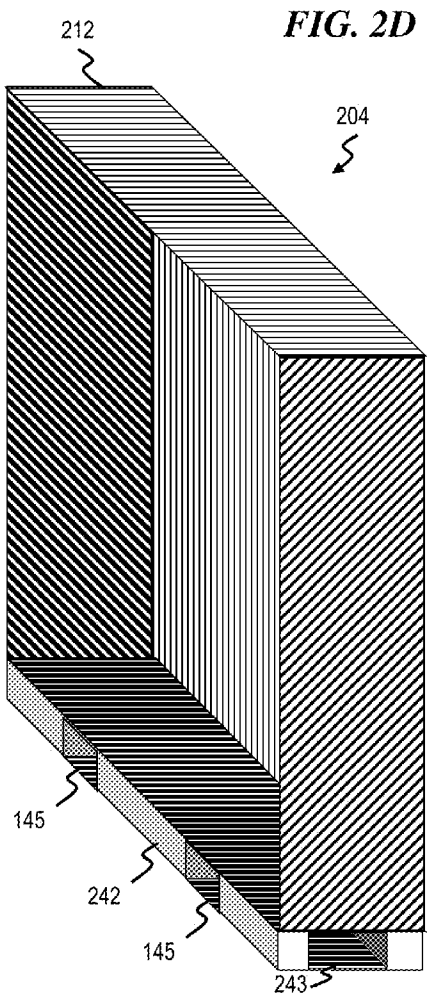
FIG. 2D is a cabinet-projection view of one part 204 of asymmetric convertible shipping container 203 in the disassembled configuration (consisting of single piece 212), according to one embodiment of the present invention.
Figure 2C:
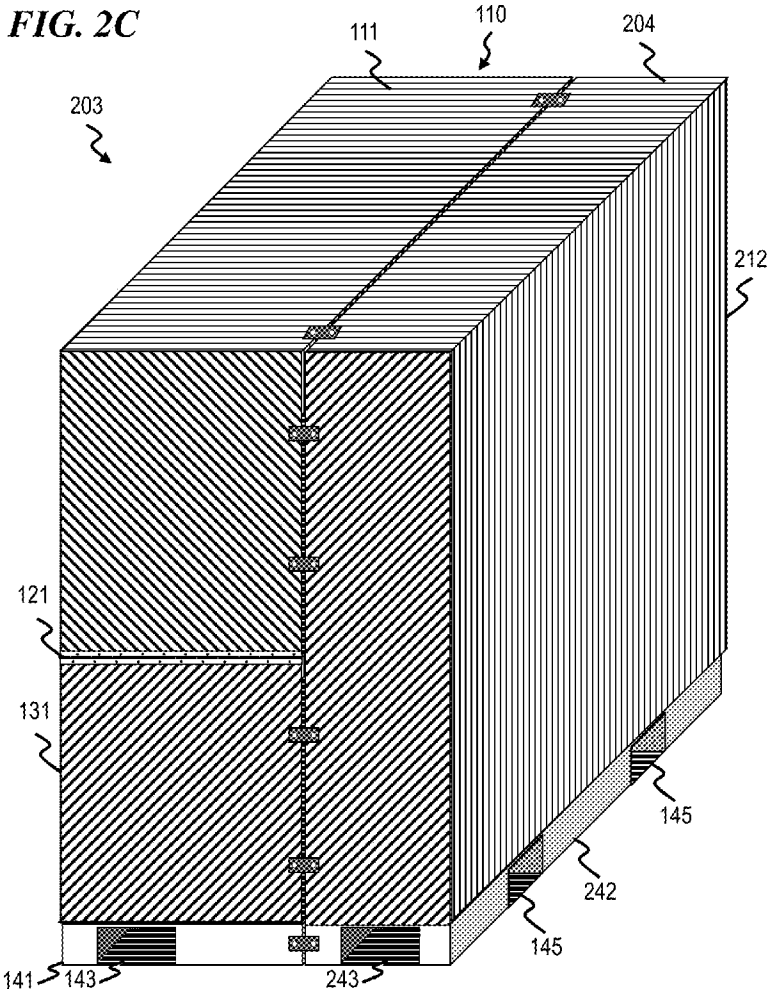
FIG. 2C is a cabinet-projection view of an asymmetric convertible shipping container 203 in the shipping-container assembled configuration, according to one embodiment of the present invention.

FIG. 2D is a cabinet-projection view of one part 204 of asymmetric convertible shipping container 203 in the disassembled configuration (consisting of single piece 212), according to one embodiment of the present invention.

Figure 2F:
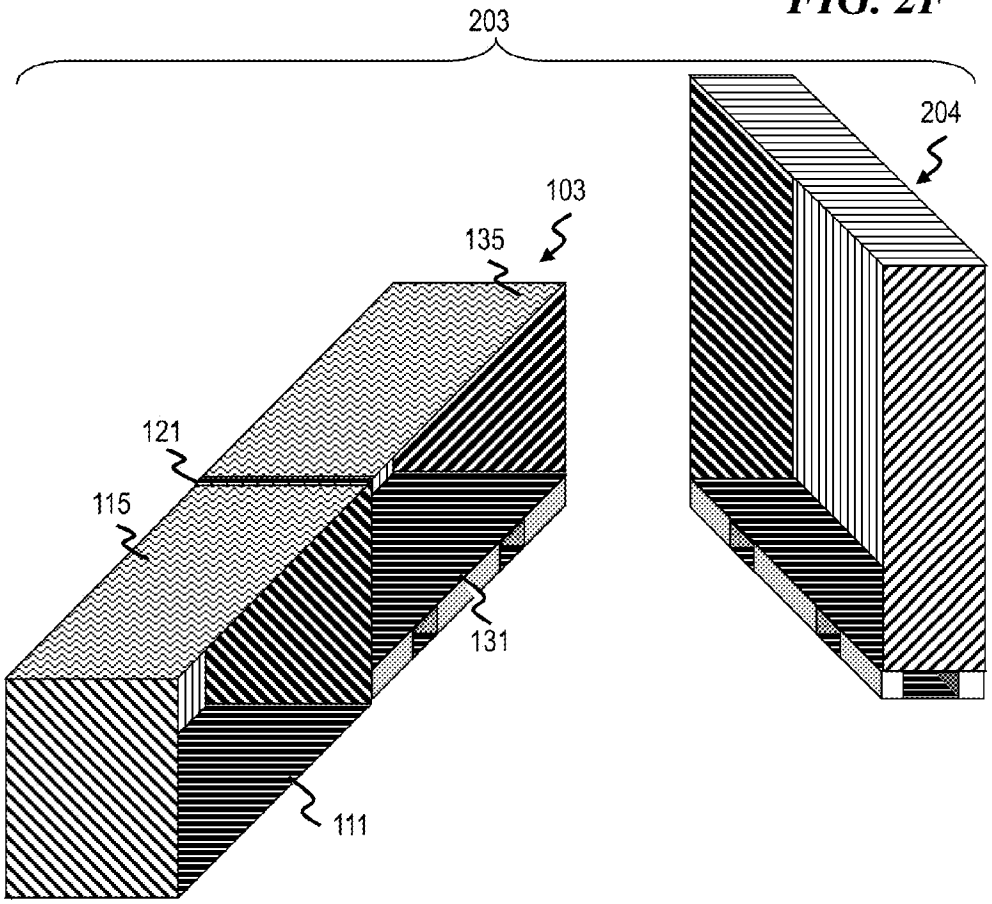
FIG. 2F is a reduced-size cabinet-projection view of asymmetric convertible shipping container 203 in an assembled tradeshow-furniture configuration of one table-like display unit 103 and one tall display case unit 204.
Figure 2E:
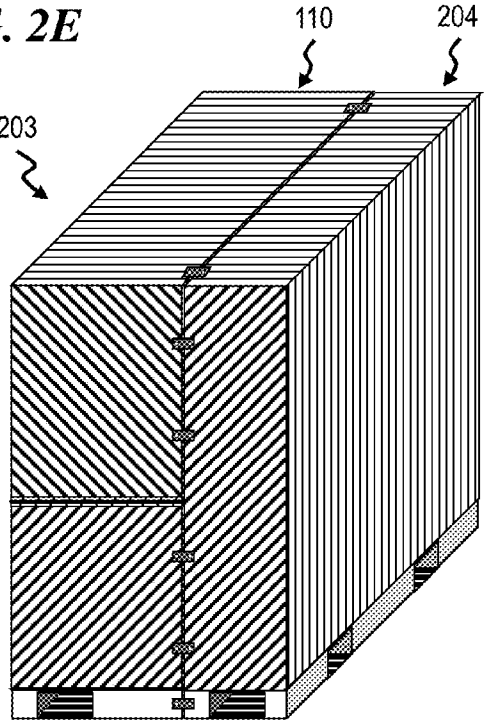
FIG. 2E is a reduced-size cabinet-projection view of an asymmetric convertible shipping container 203 in the shipping-container assembled configuration.

FIG. 2E is a reduced-size cabinet-projection view of an asymmetric convertible shipping container 203 in the shipping-container assembled configuration.

FIG. 2F is a reduced-size cabinet-projection view of asymmetric convertible shipping container 203 in an assembled tradeshow-furniture configuration of one table-like display unit 103 and one tall display case unit 204. Display table 103 is as described above for FIG. 1E. In some embodiments, tall display case unit 204 is configured with a plurality of bookshelves or as other suitable tradeshow display furniture.

Figure 2H:
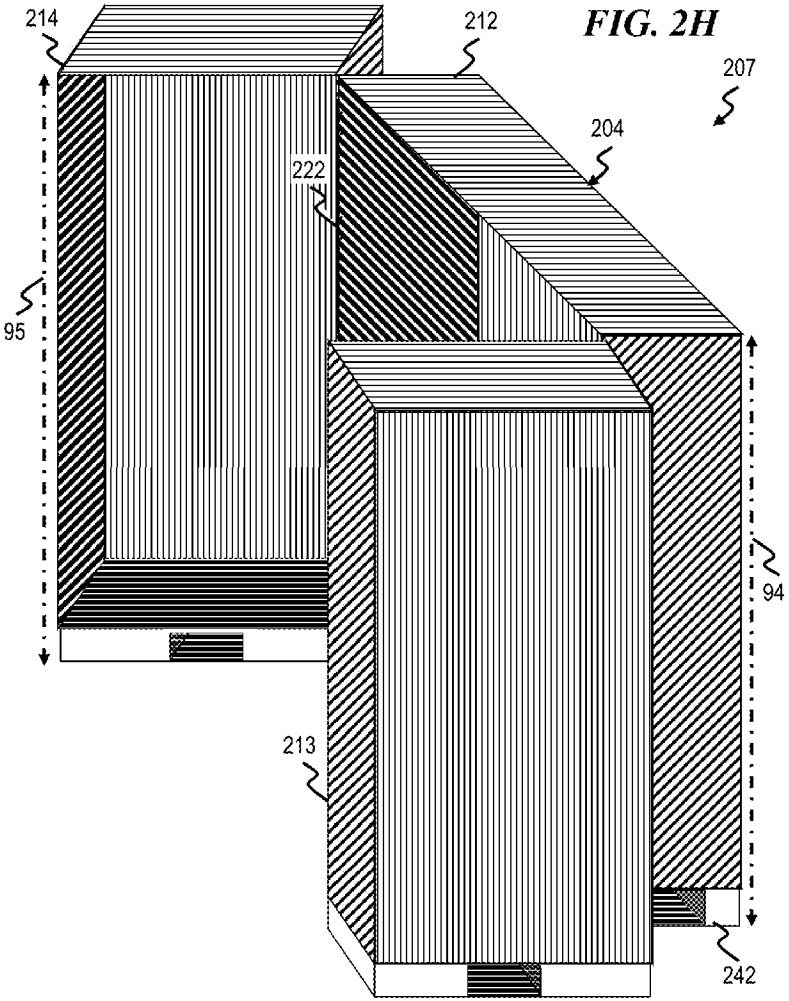
FIG. 2H is a cabinet-projection view of convertible shipping symmetric container 207 in an assembled-deployed tradeshow-furniture configuration of one table-like display unit and one tall display case unit.
Figure 2G:
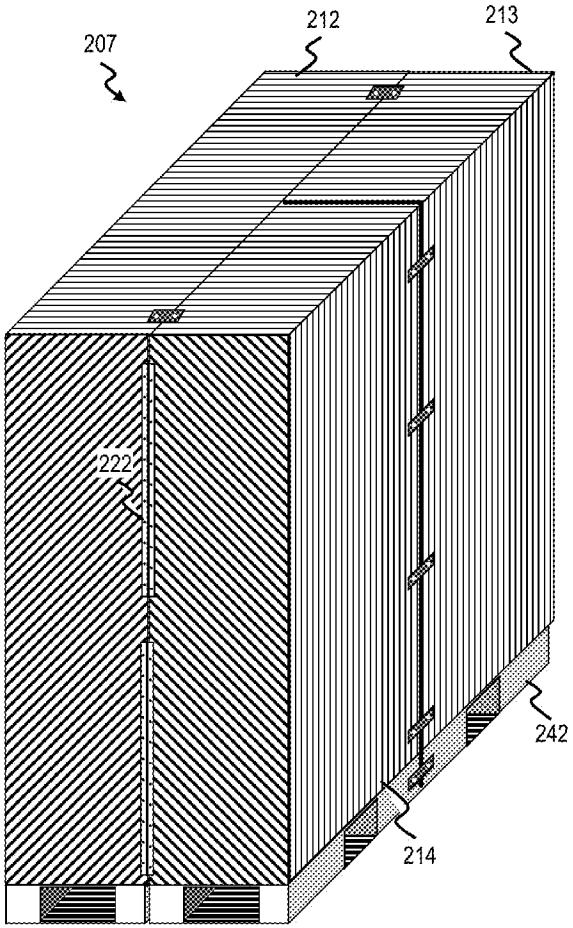
FIG. 2G is a cabinet-projection view of asymmetric convertible shipping container 207 in the shipping-container assembled configuration.

FIG. 2G is a cabinet-projection view of asymmetric convertible shipping container 207 in the shipping-container assembled configuration. In some embodiments, convertible shipping container 207 includes a plurality off tall units that are hinged together. In the embodiment shown, convertible shipping container 207 includes a full-wide unit 212 and two partial-width units (in the embodiment shown, half-wide units 213 and 214). In some embodiments, full-wide unit 212 is identical to unit 204 of FIG. 2D described above, but, in some embodiments, is hinged (using one or more hinges 222) to the half-wide units 213 and 214, which the fold out as shown in FIG. 2H. In some embodiments, each of the units includes one or more forklift receptacles as described above. In the embodiment shown, the half-wide units 213 and 214 are substantially the same depth as full-wide unit 212, however other configurations have the half-wide units 213 and 214 are deeper or shallower than full-wide unit 212. In some embodiments, the two side units 213 and 214 have different widths.

FIG. 2H is a cabinet-projection view of convertible shipping symmetric container 207 in an assembled-deployed tradeshow-furniture configuration of three attached tall display case units.

Figure 2I:
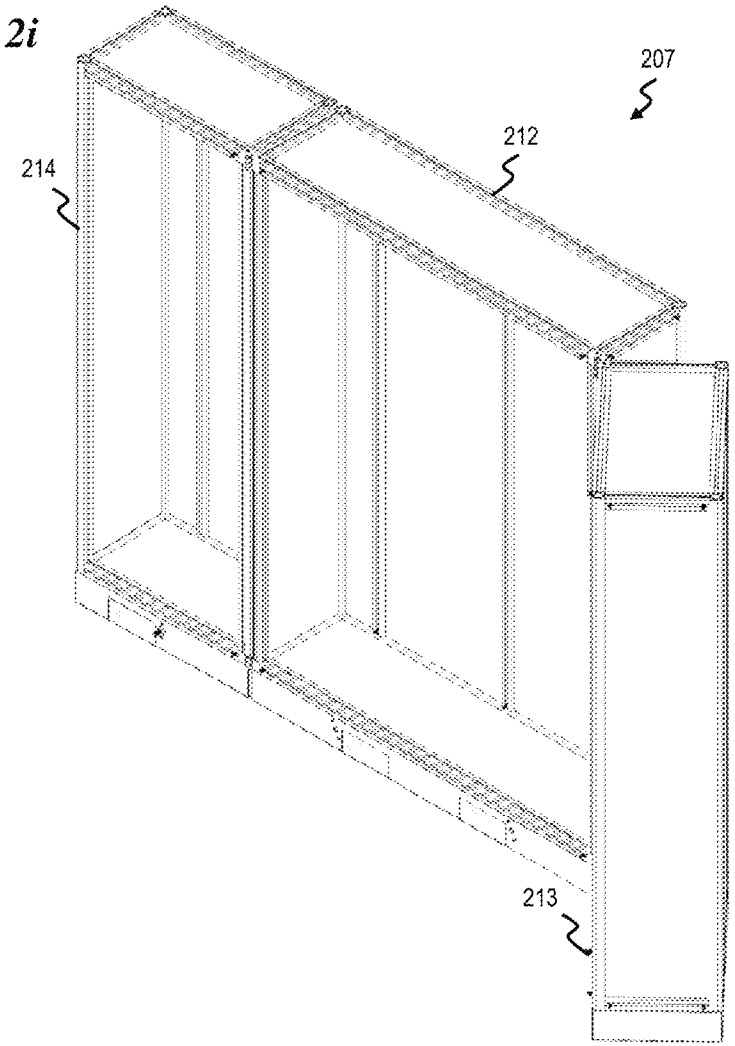
FIG. 2*i* is an isometric-projection view of convertible shipping symmetric container 207 in an assembled-deployed tradeshow-furniture configuration of three attached tall display case units.

FIG. 2*i* is an isometric-projection view of convertible shipping symmetric container 207 in an assembled-deployed tradeshow-furniture configuration of three attached tall display case units.

Figure 2L:
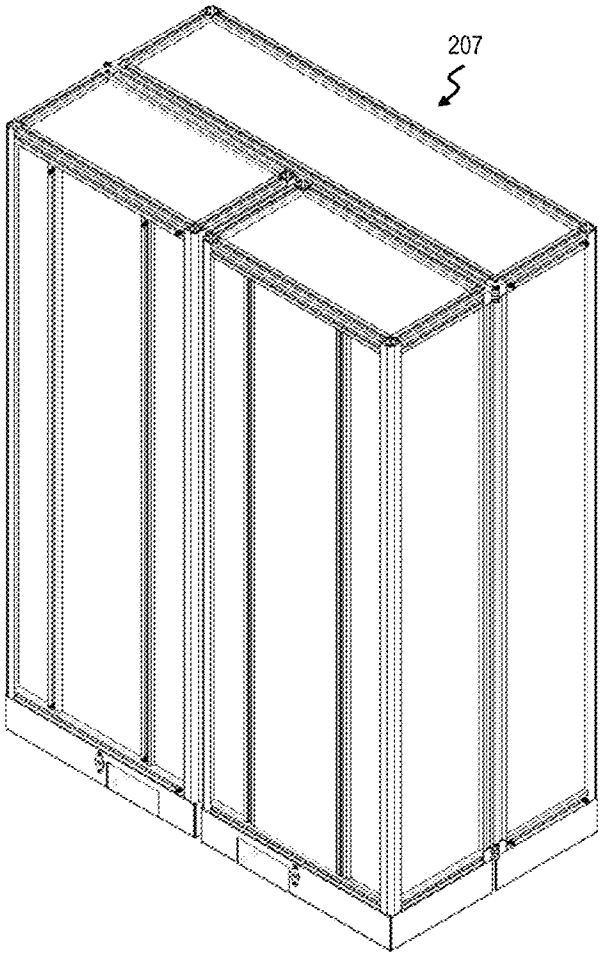
FIG. 2L is an isometric-projection view of convertible shipping symmetric container 207 in an assembled shipping-container configuration of three attached tall display case units.
Figure 2J:
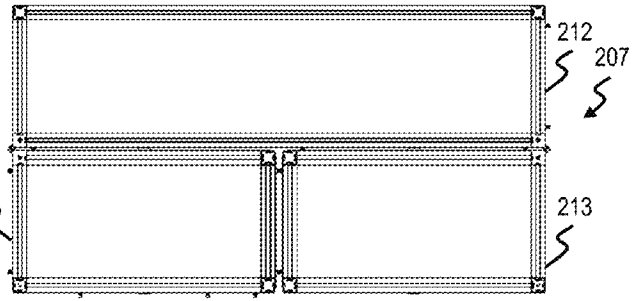
FIG. 2J is a top view of convertible shipping symmetric container 207 in an assembled shipping-container configuration of three attached tall display case units.

FIG. 2J is a top view of convertible shipping symmetric container 207 in an assembled shipping-container configuration of three attached tall display case units.

Figure 2K:
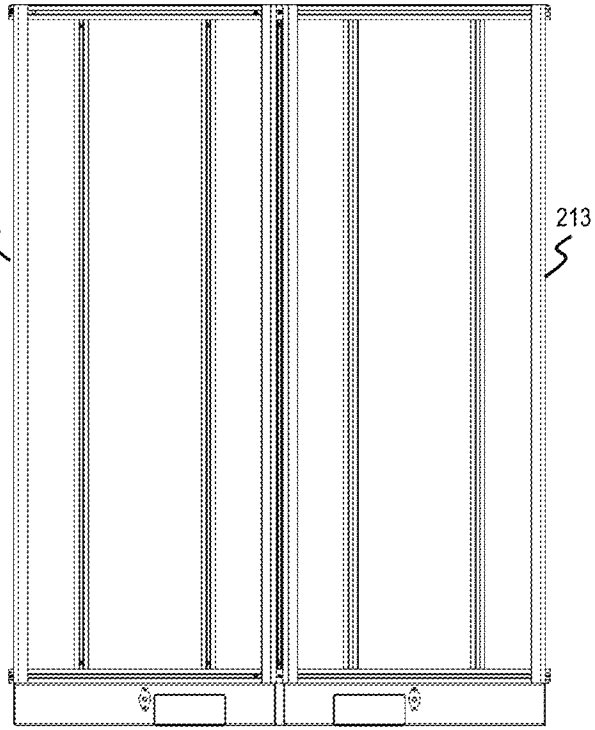
FIG. 2K is a front view of convertible shipping symmetric container 207 in an assembled shipping-container configuration of three attached tall display case units.

FIG. 2K is a front view of convertible shipping symmetric container 207 in an assembled shipping-container configuration of three attached tall display case units.

FIG. 2L is an isometric-projection view of convertible shipping symmetric container 207 in an assembled shipping-container configuration of three attached tall display case units.

In some embodiments, the present invention provides a convertible travel case apparatus that converts from a palletable shipping container into one or more display cabinet(s) and/or table(s). The apparatus includes: a first dual-box unit that includes a first open-faced box having a height and an inner volume and a second open-faced box having a height and an inner volume, wherein the first open-faced box and the second open-faced box are connected to one another along an edge of each by a first hinge, wherein the second open-faced box includes a bottom pallet portion having at least one forklift-accessible opening configured to allow the apparatus to be lifted and carried by a forklift, wherein the first dual-box unit is configured to be unfolded along an axis of the first hinge from a stacked configuration in which the first open-faced box is stacked upon the second open-faced box to a dual-table configuration in which the first open-faced box is side-by-side next to the second open-faced box, and wherein the height of the second open-faced box including the bottom pallet portion is substantially equal to the height of the first open-faced box; and a second unit that connects to the first unit to enclose the inner volume of the first open-faced box and the inner volume of the second open-faced box.

In some embodiments of the apparatus, the second unit also includes a first open-faced box having a height and an inner volume and a second open-faced box having a height and an inner volume, wherein the first open-faced box of the second unit and the second open-faced box of the second unit are connected to one another along an edge of each by a second hinge, wherein the second open-faced box includes a bottom pallet portion having at least one forklift-accessible opening configured to allow the apparatus to be lifted and carried by a forklift, wherein the second unit is configured to be unfolded along an axis of the second hinge from a stacked configuration in which the first open-faced box of the second unit is stacked upon the second open-faced box of the second unit to a dual-table configuration in which the first open-faced box of the second unit is side-by-side next to the second open-faced box of the second unit, and wherein the height of the second open-faced box of the second unit including the bottom pallet portion is substantially equal to the height of the first open-faced box of the second unit.

In some embodiments, the convertible travel case apparatus is made of plywood and/or tough resilient polymer facing sheets affixed by adhesive, rivets, bolts and/or the like to a structural frame of aluminum or steel, for example. In some embodiments, the convertible travel case apparatus is made of a tough polymer sheet blow-molded to the desired shape and size. Other materials and construction methods will be obvious to persons of skill in the art, and are included in the claimed invention.

In some embodiments, the present invention provides a convertible travel case apparatus (such as, for example, convertible shipping container 101, 201, 203, or 207) that converts from a palletable enclosed shipping container (such as shown, for example, in FIG. 1A, 1C, 1F, 1*i*, 2A, 2C, 2E, 2G or 2L) into one or more display cabinets and/or tables (such as shown, for example, in FIG. 1D, 1E, 1G, 1H, 1J, 1M, 2B, 2D, 2F, 2H or 2*i*). The convertible travel case apparatus includes a first unit (such as, for example, 110 or 212-213) that includes a plurality of open-faced boxes including: a first open-faced box (such as, for example, 111 or 212) having a height and an inner volume and a second open-faced box (such as, for example, 131 or 214) having a height and an inner volume, wherein the first open-faced box and the second open-faced box of the first unit are connected to one another along an edge of each by a first edge-connector system (such as, for example, 121 or 222), wherein the second open-faced box includes a bottom pallet portion (such as, for example, 141 or 242) having at least one forklift-accessible opening (such as, for example, 143, 145, 158 or 243) configured to allow the apparatus to be lifted and carried by a forklift, wherein the first dual-box unit is configured to be unfolded along an axis of the first edge-connector system from a first enclosed shipping configuration (such as, for example, FIG. 1C or FIG. 2G) in which the first open-faced box (such as, for example, 111 or 212) is folded against the second open-faced box (such as, for example, 131 or 214), to a second display configuration (such as, for example, FIG. 1E or FIG. 2H) in which the first open-faced box is on a floor next to the second open-faced box, and wherein the height of the second open-faced box including the bottom pallet portion (such as, for example, height 99 in FIG. 1M or height 94 in FIG. 2H) is substantially equal to the height of the first open-faced box (such as, for example, height 98 in FIG. 1M or height 95 in FIG. 2H); and a second unit that connects to the first unit to selectively enclose the inner volume of the first open-faced box and the inner volume of the second open-faced box when in the first enclosed shipping configuration.

In some embodiments of the apparatus (such as, for example, FIG. 1D or FIG. 1E), the first edge connector includes a hinge 121, wherein the axis of the hinge of the first edge connector is horizontal, and wherein the first dual-box unit is configured to be unfolded along the horizontal axis of the hinge of the first edge connector from a stacked shipping configuration in which the first open-faced box is stacked upon the second open-faced box, to a dual-table display configuration in which the first open-faced box is side-by-side next to the second open-faced box.

In some embodiments of the apparatus (such as, for example, FIG. 2C), the second unit 204 includes a single open-faced box 212 having a height and an inner volume, wherein the single open-faced box 212 of the second unit 204 includes a bottom pallet portion having at least one forklift-accessible opening configured to allow the apparatus as a whole to be lifted and carried by a forklift, wherein the second unit is configured to be moved away from the open-face-to-open-face enclosed shipping configuration in which the single open-faced box of the second unit is open-face-to-open-face facing the first open-faced box and the second open-faced box of the first unit to a tall-display plus double desk configuration in which the first open-faced box of the second unit is separated from the first open-faced box of the first unit, and wherein the height of the single open-faced box of the second unit including its bottom pallet portion is substantially equal to the combined height of the second open-faced box of the first unit stacked upon the first open-faced box of the first unit. Some embodiments further include a plurality of connectors (such as 154 shown in FIG. 1A) that connect the second unit 204 to the first unit 110 in the open-face-to-open-face enclosed shipping configuration.

In some embodiments (such as shown in FIG. 1A-1J), the second unit 120 also includes a first open-faced box 112 having a height and an inner volume and a second open-faced box 132 having a height and an inner volume, wherein the first open-faced box and the second open-faced box of the second unit 120 are connected to one another along an edge of each by a second edge connector 122, wherein the second open-faced box includes a bottom pallet portion 142 having at least one forklift-accessible opening 143 or 145 configured to allow the apparatus 101 as a whole to be lifted and carried by a forklift, wherein the second unit is configured to be unfolded along an axis of the second edge connector from a stacked configuration in which the first open-faced box of the second unit is stacked upon the second open-faced box of the second unit to a dual-table configuration in which the first open-faced box of the second unit is side-by-side next to the second open-faced box of the second unit, and wherein the height of the second open-faced box including the bottom pallet portion of the second unit is substantially equal to the height of the first open-faced box of the second unit.

In some embodiments, the second unit and the first unit have substantially equal sizes and shapes.

In some embodiments (such as shown in FIG. 2G-2L), the first edge connector includes a first hinge 222, wherein the axis of the first hinge 222 of the first edge connector is vertical, and wherein the first dual-box unit (such as 212 and 214 together) is configured to be unfolded along the vertical axis of the first hinge from a open-face-to-open-face enclosed shipping configuration in which the first open-faced box encloses at least a portion of the second open-faced box, to a display configuration in which the first open-faced box is side-by-side next to the second open-faced box. In some such embodiments, the second unit includes a first open-faced box 213 having a height and an inner volume, wherein the first open-faced box 213 of the second unit is connected by a second hinge to the first open-faced box 212 of the first unit (such as 212 and 214 together) along an edge of the first open-faced box 212 of the first unit that is on an opposite side of the first open-faced box of the first unit relative to the second open-faced box 214 of the first unit, wherein the first open-faced box of the second unit includes a bottom pallet portion having at least one forklift-accessible opening configured to allow the apparatus to be lifted and carried by a forklift, wherein the second unit is configured to be unfolded along the vertical axis of the second hinge from the open-face-to-open-face enclosed shipping configuration in which the first open-faced box of the second unit is open-face-to-open-face facing the first open-faced box of the first unit to a triple-display configuration in which the first open-faced box of the second unit is side-by-side next to the first open-faced box of the first unit, and wherein the height of the first open-faced box of the second unit including its bottom pallet portion is substantially equal to the height of the first open-faced box of the first unit. In some such embodiments, the first open-faced box 213 of the second unit and the second open-faced box 214 of the first unit together have a total width equal to a width of the first open-faced box 212 of the first unit.

In some embodiments, the present invention provides a method for making a convertible travel case that converts from a palletable enclosed shipping container into one or more display cabinets and/or tables. This method includes forming a first unit of the container that includes a plurality of open-faced boxes including a first open-faced box having a height and an inner volume and a second open-faced box having a height and an inner volume, including forming the second open-faced box on a bottom pallet portion having at least one forklift-accessible opening configured to allow the convertible travel case to be lifted and carried by a forklift, wherein the height of the second open-faced box including the bottom pallet portion is substantially equal to the height of the first open-faced box; forming a second unit of the container; connecting the first open-faced box and the second open-faced box of the first unit to one another along an edge of each; unfolding the first dual-box unit along an axis of the connected edges of the first open-faced box and the second open-faced box of the first unit from a first enclosed shipping configuration in which the first open-faced box is folded against the second open-faced box, to a second display configuration in which the first open-faced box is on a floor next to the second open-faced box; and removably connecting a second unit to the first unit to selectively enclose the inner volume of the first open-faced box and the inner volume of the second open-faced box when in the first enclosed shipping configuration.

In some embodiments of the method, the connecting the first open-faced box and the second open-faced box of the first unit includes using a first hinge, wherein the axis of the first hinge is horizontal, and wherein the unfolding of the first dual-box unit is done along the horizontal axis of the first hinge from a stacked shipping configuration in which the first open-faced box is stacked upon the second open-faced box, to a dual-table display configuration in which the first open-faced box is side-by-side next to the second open-faced box.

In some embodiments of the method, the forming of the second unit includes forming a single open-faced box having a height and an inner volume, and forming at least one forklift-accessible opening in a bottom pallet portion of the second unit that allows the case as a whole to be lifted and carried by a forklift, wherein the height of the single open-faced box of the second unit including its bottom pallet portion is substantially equal to the combined height of the second open-faced box of the first unit stacked upon the first open-faced box of the first unit, The method further includes moving the second unit away from the open-face-to-open-face enclosed shipping configuration in which the single open-faced box of the second unit is open-face-to-open-face facing the first open-faced box and the second open-faced box of the first unit to a tall-display plus double desk configuration in which the first open-faced box of the second unit is separated from the first open-faced box of the first unit.

Some embodiments of the method further include connecting the second unit to the first unit in the open-face-to-open-face enclosed shipping configuration using a plurality of connectors.

In some embodiments of the method, the forming of the second unit also includes forming a first open-faced box having a height and an inner volume and a second open-faced box having a height and an inner volume, and wherein the second open-faced box of the second unit includes a bottom pallet portion having at least one forklift-accessible opening configured to allow the case as a whole to be lifted and carried by a forklift, and wherein the height of the second open-faced box including the bottom pallet portion of the second unit is substantially equal to the height of the first open-faced box of the second unit, the method further including: connecting the first open-faced box and the second open-faced box of the first unit to one another along an edge of each; unfolding the second unit along an axis of the connected edges of the first open-faced box and the second open-faced box of the second unit from a stacked configuration in which the first open-faced box of the second unit is stacked upon the second open-faced box of the second unit to a dual-table configuration in which the first open-faced box of the second unit is side-by-side next to the second open-faced box of the second unit.

In some embodiments of the method, the second unit and the first unit have substantially equal sizes and shapes as one another.

In some embodiments of the method, the connecting of the first open-faced box and the second open-faced box of the first unit includes using a first hinge, wherein the axis of the first hinge is vertical, and wherein unfolding of the first dual-box unit is done along the vertical axis of the first hinge from a open-face-to-open-face shipping configuration in which the first open-faced box encloses at least a portion of the second open-faced box, to a display configuration in which the first open-faced box is side-by-side next to the second open-faced box.

In some embodiments of the method, the forming of the second unit includes forming a first open-faced box having a height and an inner volume, and the method further includes: connecting the first open-faced box of the second unit by a second hinge to the first open-faced box of the first unit along an edge of the first open-faced box of the first unit that is on an opposite side of the first open-faced box of the first unit relative to the second open-faced box of the first unit, wherein the first open-faced box of the second unit includes a bottom pallet portion having at least one forklift-accessible opening configured to allow the case to be lifted and carried by a forklift, and unfolding the second unit along the vertical axis of the second hinge from the open-face-to-open-face enclosed shipping configuration in which the first open-faced box of the second unit is open-face-to-open-face facing the first open-faced box of the first unit to a triple-display configuration in which the first open-faced box of the second unit is side-by-side next to the first open-faced box of the first unit, and wherein the height of the first open-faced box of the second unit including its bottom pallet portion is substantially equal to the height of the first open-faced box of the first unit.

In some embodiments, the present invention provides a convertible travel case apparatus that converts from a palletable enclosed shipping container into one or more display cabinets and/or tables. This apparatus includes: open-faced means for enclosing a first inner volume; open-faced means for enclosing a second inner volume; means for connecting the open-faced means for enclosing the first inner volume to the open-faced means for enclosing the second inner volume; wherein the open-faced means for enclosing a second inner volume includes means for receiving a forklift fork to allow the apparatus to be lifted and carried by the forklift, wherein a height of the open-faced means for enclosing the second inner volume including the means for receiving the forklift fork is substantially equal to a height of the open-faced means for enclosing the first inner volume; means for unfolding along an edge axis the open-faced means for enclosing the first inner volume relative to the open-faced means for enclosing the second inner volume, thus going from a first enclosed shipping configuration in which the open-faced means for enclosing the first inner volume is folded against the open-faced means for enclosing the second inner volume, to a second display configuration in which the open-faced means for enclosing the first inner volume is on a floor next to the open-faced means for enclosing the second inner volume, and means for selectively enclosing the first inner volume and the second inner volume when in the first enclosed shipping configuration.

In some embodiments of the apparatus, the means for connecting the open-faced means for enclosing the first inner volume to the open-faced means for enclosing the second inner volume includes a first hinge, wherein the axis of the first hinge is horizontal, and wherein the means for unfolding is done along the horizontal axis of the first hinge from a stacked shipping configuration in which the open-faced means for enclosing the first inner volume is stacked upon the open-faced means for enclosing the second inner volume, to a dual-table display configuration in which the open-faced means for enclosing the first inner volume is side-by-side next to the open-faced means for enclosing the second inner volume.

In some embodiments of the apparatus, the means for selectively enclosing the first inner volume and the second inner volume when in the first enclosed shipping configuration includes means for selectively enclosing a third inner volume when the apparatus is in the first enclosed shipping configuration; means for receiving a forklift fork, wherein a height of the means for selectively enclosing a third inner volume including its means for receiving a forklift fork is substantially equal to the combined height of the open-faced means for enclosing a second inner volume stacked upon the open-faced means for enclosing a first inner volume, and the apparatus further includes means for moving the means for selectively enclosing a third inner volume away from the open-face-to-open-face enclosed shipping configuration in which the means for selectively enclosing the third inner volume is open-face-to-open-face facing the open-faced means for enclosing the second inner volume stacked upon the open-faced means for enclosing the first second inner volume, and to a tall-display plus double desk configuration in which the means for selectively enclosing the third inner volume is separated from the means for selectively enclosing the first inner volume.

It is to be understood that the above description is intended to be illustrative, and not restrictive. Although numerous characteristics and advantages of various embodiments as described herein have been set forth in the foregoing description, together with details of the structure and function of various embodiments, many other embodiments and changes to details will be apparent to those of skill in the art upon reviewing the above description. The scope of the invention should be, therefore, determined with reference to the appended claims, along with the full scope of equivalents to which such claims are entitled. In the appended claims, the terms "including" and "in which" are used as the plain-English equivalents of the respective terms "comprising" and "wherein," respectively. Moreover, the terms "first," "second," and "third," etc., are used merely as labels, and are not intended to impose numerical requirements on their objects.

What is claimed is:

1. A convertible travel case apparatus that converts from a palletized enclosed shipping container into at least one of a first display cabinet and a first table, the apparatus comprising:

a first unit that includes a plurality of open-faced boxes including a first open-faced box having a height and an inner volume and a second open-faced box having a height and an inner volume, wherein the first open-faced box and the second open-faced box of the first unit are connected to one another along an edge of each by a first edge-connector system, wherein the second open-faced box includes a bottom pallet portion having at least one forklift-accessible opening configured to allow the apparatus to be lifted and carried by a forklift, wherein the convertible travel case apparatus is configured to be unfolded along an axis of the first edge-connector system from a first enclosed shipping configuration in which the first open-faced box is folded against the second open-faced box, to a second display configuration in which the first open-faced box is on a floor next to the second open-faced box, and wherein the height of the second open-faced box including the bottom pallet portion is substantially equal to the height of the first open-faced box; and a second unit that connects to the first unit to selectively enclose the inner volume of the first open-faced box and the inner volume of the second open-faced box when in the first enclosed shipping configuration.

2. The apparatus of claim 1, wherein the first edge-connector system includes a hinge, wherein the axis of the hinge of the first edge-connector system is horizontal, and wherein the convertible travel case apparatus is configured to be unfolded along the horizontal axis of the hinge of the first edge-connector system from a stacked shipping configuration in which the first open-faced box is stacked upon the second open-faced box, to a configuration in which the first open-faced box is side-by-side next to the second open-faced box.

3. The apparatus of claim 2, wherein the second unit includes a single open-faced box having a height and an inner volume, wherein the single open-faced box of the second unit includes a bottom pallet portion having at least one forklift-accessible opening configured to allow the apparatus as a whole to be lifted and carried by a forklift, wherein the second unit is configured to be moved away from the open-face-to-open-face enclosed shipping configuration in which the single open-faced box of the second unit is open-face-to-open-face facing the first open-faced box and the second open-faced box of the first unit to a configuration in which the first open-faced box of the second unit is separated from the first open-faced box of the first unit, and wherein the height of the single open-faced box of the second unit including its bottom pallet portion is substantially equal to the combined height of the second open-faced box of the first unit stacked upon the first open-faced box of the first unit.

4. The apparatus of claim 3, further comprising a plurality of connectors that connect the second unit to the first unit in the open-face-to-open-face enclosed shipping configuration.

5. The apparatus of claim 1, wherein the second unit also includes a first open-faced box having a height and an inner volume and a second open-faced box having a height and an inner volume, wherein the first open-faced box and the second open-faced box of the second unit are connected to one another along an edge of each by a second edge connector system, wherein the second open-faced box includes a bottom pallet portion having at least one forklift-accessible opening configured to allow the apparatus as a whole to be lifted and carried by a forklift, wherein the second unit is configured to be unfolded along an axis of the second edge connector system from a stacked configuration in which the first open-faced box of the second unit is stacked upon the second open-faced box of the second unit to a configuration in which the first open-faced box of the second unit is side-by-side next to the second open-faced box of the second unit, and wherein the height of the second open-faced box including the bottom pallet portion of the second unit is substantially equal to the height of the first open-faced box of the second unit.

6. The apparatus of claim 1, wherein the second unit and the first unit have substantially equal sizes and shapes.

7. The apparatus of claim 1, wherein the first edge-connector system includes a first hinge, wherein the axis of the first hinge of the first edge-connector system is vertical, and wherein the convertible travel case apparatus is configured to be unfolded along the vertical axis of the first hinge from a open-face-to-open-face enclosed shipping configuration in which the first open-faced box encloses at least a portion of the second open-faced box, to a display configuration in which the first open-faced box is side-by-side next to the second open-faced box.

8. The apparatus of claim 7, wherein the second unit includes a first open-faced box having a height and an inner volume, wherein the first open-faced box of the second unit is connected by a second hinge to the first open-faced box of the first unit along an edge of the first open-faced box of the first unit that is on an opposite side of the first open-faced box of the first unit relative to the second open-faced box of the first unit, wherein the first open-faced box of the second unit includes a bottom pallet portion having at least one forklift-accessible opening configured to allow the apparatus to be lifted and carried by a forklift, wherein the second unit is configured to be unfolded along the vertical axis of the second hinge from the open-face-to-open-face enclosed shipping configuration in which the first open-faced box of the second unit is open-face-to-open-face facing the first open-faced box of the first unit to a configuration in which the first open-faced box of the second unit is side-by-side next to the first open-faced box of the first unit, and wherein the height of the first open-faced box of the second unit including its bottom pallet portion is substantially equal to the height of the first open-faced box of the first unit.

9. The apparatus of claim 8, wherein the first open-faced box of the second unit and the second open-faced box of the first unit together have a total width equal to a width of the first open-faced box of the first unit.

10. A method for making a convertible travel case that converts from a palletized enclosed shipping container into at least one of a display cabinet and a table, the method comprising:

forming a first unit of the container that includes a plurality of open-faced boxes including a first open-faced box having a height and an inner volume and a second open-faced box having a height and an inner volume, including forming the second open-faced box on a bottom pallet portion having at least one forklift-accessible opening configured to allow the convertible travel case to be lifted and carried by a forklift, wherein the height of the second open-faced box including the bottom pallet portion is substantially equal to the height of the first open-faced box;

forming a second unit of the container;

connecting the first open-faced box and the second open-faced box of the first unit to one another along an edge of each;

unfolding the convertible travel case along an axis of the connected edges of the first open-faced box and the second open-faced box of the first unit from a first enclosed shipping configuration in which the first open-faced box is folded against the second open-faced box, to a second display configuration in which the first open-faced box is on a floor next to the second open-faced box; and removably connecting a second unit to the first unit to selectively enclose the inner volume of the first open-faced box and the inner volume of the second open-faced box when in the first enclosed shipping configuration.

11. The method of claim 10, wherein the connecting of the first open-faced box and the second open-faced box of the first unit includes using a first hinge, wherein the axis of the first hinge is horizontal, and wherein the unfolding of the convertible travel case is done along the horizontal axis of the first hinge from a stacked shipping configuration in which the first open-faced box is stacked upon the second open-faced box, to a configuration in which the first open-faced box is side-by-side next to the second open-faced box.

12. The method of claim 11, wherein the forming of the second unit includes forming a single open-faced box having a height and an inner volume, and forming at least one forklift-accessible opening in a bottom pallet portion of the second unit that allows the case as a whole to be lifted and carried by a forklift, wherein the height of the single open-faced box of the second unit including its bottom pallet portion is substantially equal to the combined height of the second open-faced box of the first unit stacked upon the first open-faced box of the first unit, the method further comprising:

moving the second unit away from the open-face-to-open-face enclosed shipping configuration in which the single open-faced box of the second unit is open-face-to-open-face facing the first open-faced box and the second open-faced box of the first unit to a configuration in which the first open-faced box of the second unit is separated from the first open-faced box of the first unit.

13. The method of claim 12, further comprising connecting the second unit to the first unit in the open-face-to-open-face enclosed shipping configuration using a plurality of connectors.

14. The method of claim 10, wherein the forming of the second unit also includes forming a first open-faced box having a height and an inner volume and a second open-faced box having a height and an inner volume, and wherein the second open-faced box of the second unit includes a bottom pallet portion having at least one forklift-accessible opening configured to allow the case as a whole to be lifted and carried by a forklift, and wherein the height of the second open-faced box including the bottom pallet portion of the second unit is substantially equal to the height of the first open-faced box of the second unit, the method further comprising:

connecting the first open-faced box and the second open-faced box of the first unit to one another along an edge of each; and unfolding the second unit along an axis of the connected edges of the first open-faced box and the second open-faced box of the second unit from a stacked configuration in which the first open-faced box of the second unit is stacked upon the second open-faced box of the second unit to a configuration in which the first open-faced box of the second unit is side-by-side next to the second open-faced box of the second unit.

15. The method of claim 14, wherein the second unit and the first unit have substantially equal sizes and shapes as one another.

16. The method of claim 14, wherein the connecting of the first open-faced box and the second open-faced box of the first unit includes using a first hinge, wherein the axis of the first hinge is vertical, and wherein unfolding of the convertible travel case is done along the vertical axis of the first hinge from a open-face-to-open-face shipping configuration in which the first open-faced box encloses at least a portion of the second open-faced box, to a display configuration in which the first open-faced box is side-by-side next to the second open-faced box.

17. The method of claim 10, wherein the forming of the second unit includes forming a first open-faced box having a height and an inner volume, and wherein the method further includes:

connecting the first open-faced box of the second unit by a second hinge to the first open-faced box of the first unit along an edge of the first open-faced box of the first unit that is on an opposite side of the first open-faced box of the first unit relative to the second open-faced box of the first unit, wherein the first open-faced box of the second unit includes a bottom pallet portion having at least one forklift-accessible opening configured to allow the case to be lifted and carried by a forklift; and unfolding the second unit along the vertical axis of the second hinge from the open-face-to-open-face enclosed shipping configuration in which the first open-faced box of the second unit is open-face-to-open-face facing the first open-faced box of the first unit to a configuration in which the first open-faced box of the second unit is side-by-side next to the first open-faced box of the first unit, and wherein the height of the first open-faced box of the second unit including its bottom pallet portion is substantially equal to the height of the first open-faced box of the first unit.

18. A convertible travel case apparatus that converts from a palletized enclosed shipping container into at least one of a display cabinet and a table, the apparatus comprising:

open-faced means for enclosing a first inner volume;

open-faced means for enclosing a second inner volume;

means for connecting the open-faced means for enclosing the first inner volume to the open-faced means for enclosing the second inner volume;

wherein the open-faced means for enclosing a second inner volume includes means for receiving a forklift fork to allow the apparatus to be lifted and carried by the forklift, wherein a height of the open-faced means for enclosing the second inner volume including the means for receiving the forklift fork is substantially equal to a height of the open-faced means for enclosing the first inner volume;

means for unfolding, along an edge axis of an edge, the open-faced means for enclosing the first inner volume relative to the open-faced means for enclosing the second inner volume, thus going from a first enclosed shipping configuration in which the open-faced means for enclosing the first inner volume is folded against the open-faced means for enclosing the second inner volume, to a second display configuration in which the open-faced means for enclosing the first inner volume is on a floor next to the open-faced means for enclosing the second inner volume, and means for selectively enclosing the first inner volume and the second inner volume when in the first enclosed shipping configuration.

19. The apparatus of claim 18, wherein the means for connecting the open-faced means for enclosing the first inner volume to the open-faced means for enclosing the second inner volume includes a first hinge, wherein the axis of the first hinge is horizontal, and wherein the means for unfolding is done along the horizontal axis of the first hinge from a stacked shipping configuration in which the open-faced means for enclosing the first inner volume is stacked upon the open-faced means for enclosing the second inner volume, to a configuration in which the open-faced means for enclosing the first inner volume is side-by-side next to the open-faced means for enclosing the second inner volume.

20. The apparatus of claim 19, wherein means for selectively enclosing the first inner volume and the second inner volume when in the first enclosed shipping configuration includes:

means for selectively enclosing a third inner volume when the apparatus is in the first enclosed shipping configuration;

means for receiving a forklift fork, wherein a height of the means for selectively enclosing a third inner volume including its means for receiving a forklift fork is substantially equal to the combined height of the open-faced means for enclosing a second inner volume stacked upon the open-faced means for enclosing a first inner volume, the apparatus further comprising:

means for moving the means for selectively enclosing a third inner volume away from the open-face-to-open-face enclosed shipping configuration in which the means for selectively enclosing the third inner volume is open-face-to-open-face facing the open-faced means for enclosing the second inner volume stacked upon the open-faced means for enclosing the first second inner volume, and to a configuration in which the means for selectively enclosing the third inner volume is separated from the means for selectively enclosing the first inner volume.

* * * * *